US008898062B2

(12) United States Patent
Kato et al.

(10) Patent No.: US 8,898,062 B2
(45) Date of Patent: Nov. 25, 2014

(54) STRAINED-ROUGH-VOICE CONVERSION DEVICE, VOICE CONVERSION DEVICE, VOICE SYNTHESIS DEVICE, VOICE CONVERSION METHOD, VOICE SYNTHESIS METHOD, AND PROGRAM

(75) Inventors: Yumiko Kato, Osaka (JP); Takahiro Kamai, Kyoto (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 1306 days.

(21) Appl. No.: 12/438,860

(22) PCT Filed: Jan. 22, 2008

(86) PCT No.: PCT/JP2008/050815

§ 371 (c)(1),
(2), (4) Date: Feb. 25, 2009

(87) PCT Pub. No.: WO2008/102594

PCT Pub. Date: Aug. 28, 2008

(65) Prior Publication Data

US 2009/0204395 A1 Aug. 13, 2009

(30) Foreign Application Priority Data

Feb. 19, 2007 (JP) ..... 2007-038315

(51) Int. Cl.
*G10L 13/00* (2006.01)
*G10L 13/033* (2013.01)
*G10L 21/013* (2013.01)

(52) U.S. Cl.
CPC ..... *G10L 13/033* (2013.01); *G10L 2021/0135* (2013.01)
USPC ..... 704/266; 704/278; 704/268; 704/E13.014

(58) Field of Classification Search
CPC ..... G10L 13/08; G10L 13/043; G10L 13/04; G10L 19/02; G10L 19/10; G10L 13/07; G10L 13/00; G10L 13/033; G10L 2021/0135; G10L 13/10; G10L 13/047; G10L 15/265; G10L 15/1807; G10L 17/26; G10L 15/20; G10L 21/0216; G10L 21/00; G10L 2021/03646; H05K 999/99; G06F 3/16; G11B 27/034; G11B 27/34
USPC ..... 704/260, 266, 261, 268, 200, 206, 223, 704/258, 272, 278, E13.001, E13.004, 704/E13.005, E13.006, E13.008, E13.014, 704/E15.025, E15.039, E21.001, E21.008
See application file for complete search history.

(56) References Cited

U.S. PATENT DOCUMENTS

| | | | | | |
|---|---|---|---|---|---|
| 3,510,588 | A * | 5/1970 | Stewart | ..... | 704/258 |
| 3,892,919 | A * | 7/1975 | Ichikawa | ..... | 704/267 |
| 5,463,713 | A * | 10/1995 | Hasegawa | ..... | 704/260 |
| 5,524,173 | A * | 6/1996 | Puckette | ..... | 704/268 |
| 5,559,927 | A * | 9/1996 | Clynes | ..... | 704/258 |
| 5,748,838 | A * | 5/1998 | Stevens | ..... | 704/261 |
| 5,758,320 | A * | 5/1998 | Asano | ..... | 704/258 |
| 6,289,310 | B1 * | 9/2001 | Miller et al. | ..... | 704/268 |
| 6,304,846 | B1 * | 10/2001 | George et al. | ..... | 704/270 |
| 6,421,642 | B1 * | 7/2002 | Saruhashi | ..... | 704/268 |
| 6,477,495 | B1 * | 11/2002 | Nukaga et al. | ..... | 704/268 |
| 6,629,067 | B1 * | 9/2003 | Saito et al. | ..... | 704/207 |
| 6,629,076 | B1 * | 9/2003 | Haken | ..... | 704/271 |
| 6,647,123 | B2 * | 11/2003 | Kandel et al. | ..... | 381/318 |
| 6,865,533 | B2 * | 3/2005 | Addison et al. | ..... | 704/260 |
| 7,117,154 | B2 * | 10/2006 | Yoshioka et al. | ..... | 704/258 |
| 7,139,699 | B2 * | 11/2006 | Silverman et al. | ..... | 704/206 |
| 7,562,018 | B2 * | 7/2009 | Kamai et al. | ..... | 704/268 |
| 2003/0055646 | A1 * | 3/2003 | Yoshioka et al. | ..... | 704/258 |
| 2003/0055647 | A1 * | 3/2003 | Yoshioka et al. | ..... | 704/258 |
| 2003/0061047 | A1 * | 3/2003 | Yoshioka et al. | ..... | 704/258 |
| 2003/0093280 | A1 * | 5/2003 | Oudeyer | ..... | 704/266 |
| 2003/0163320 | A1 | 8/2003 | Yamazaki et al. | | |
| 2005/0125227 | A1 * | 6/2005 | Kamai et al. | ..... | 704/258 |
| 2005/0197832 | A1 * | 9/2005 | Vandali et al. | ..... | 704/206 |
| 2006/0080087 | A1 * | 4/2006 | Vandali et al. | ..... | 704/207 |
| 2006/0111903 | A1 | 5/2006 | Kemmochi et al. | | |
| 2009/0234652 | A1 * | 9/2009 | Kato et al. | ..... | 704/260 |

FOREIGN PATENT DOCUMENTS

| | | |
|---|---|---|
| JP | 03-174597 | 7/1991 |
| JP | 07-072900 | 3/1995 |
| JP | 2002-6900 | 1/2002 |
| JP | 2002-73064 | 3/2002 |
| JP | 2002-73068 | 3/2002 |
| JP | 2002-258886 | 9/2002 |
| JP | 2002-268699 | 9/2002 |
| JP | 2003-84798 | 3/2003 |
| JP | 2004-279436 | 10/2004 |
| JP | 2005-189483 | 7/2005 |
| JP | 2005-266349 | 9/2005 |
| JP | 3703394 | 10/2005 |
| JP | 2006-84619 | 3/2006 |
| JP | 2006-145867 | 6/2006 |
| JP | 2006-227589 | 8/2006 |
| WO | 2006/123539 | 11/2006 |
| WO | 2007/010680 | 1/2007 |

OTHER PUBLICATIONS

Lemmetty. "Review of Speech Synthesis Technology" 1999.*
Gopalan. "On the Effect of Stress on Certain Modulation Parameters of Speech" 2001.*
Huang et al. "Recent Improvements on Microsoft's Trainable Text-To-Speech System—Whistler" 1997.*
Pincas et al. "Amplitude modulation of turbulence noise by voicing in fricatives" Dec. 2006.*
Lee et al. "An Articulatory Study of Emotional Speech Production" 2005.*
Ostendorf et al. "The Impact of Speech Recognition on Speech Synthesis" 2002.*
Fujisaki et al. "Realization of Linguistic Information in the Voice Fundamental Frequency Contour of the Spoken Japanese" 1988.*
Oudeyer. "The production and recognition of emotions in speech: features and algorithms" 2003.*
Saitou et al. "Speech-To-Singing Synthesis: Converting Speaking Voices to Singing Voices by Controlling Acoustic Features Unique to Singing Voices" Oct. 2007.*
Saitou et al. "Development of an F0 control model based on F0 dynamic characteristics for singing-voice synthesis" 2004.*
Verfaille et al. "Adaptive Digital Audio Effects (A-DAFx): A New Class of Sound Transformations" 2006.*
Omori et al., Acoustic Characteristics of Rough Voice: Subharmonics, Journal of Voice, vol. 11, No. 1, pp. 40-47, 1997.*
International Search Report issued May 1, 2008 in the International (PCT) Application No. JP/2008/050815.
Kazuhiko Murakami et al., "Onsei Gosei ni Okeru All -Pass Filter ni yoru Boon Teijobu no Yuragi Gosei," The Acoustical Society of Japan (ASJ) Heisei 5 Nen Shuki Kenkyu Happyokai Koen Ronbunshu-1, Oct. 1993, 1-7-8, pp. 607-608.
Curtis Roads et al., "Konpyuta Ongaku—Rekishi, Tekunorogi, Ato," translated and edited by Aoyagi Tatsuya et al., Tokyo Denki University Press, Jan. 2001, pp. 353-355 and its original text, "The Computer Music Tutorial," The MIT Press, Jan. 2001, pp. 437-439.
Dennis H. Klatt et al., "Analysis, Synthesis, and Perception of Voice Quality Variations Among Female and Male Talkers," J. Acoust. Soc. Am. vol. 87 (2), Feb. 1990, pp. 820-857.
Niimi Seiji, "Onsei seisei no kagaku-hassei to sonoshogai," Ishiyaku Publishers, Mar. 2003, pp. 196-198 and its original text, Ingo R. Titze, "Principles of Voice Production," Chapter 10, Figure 10.2 of p. 284, from line 6 of pp. 286-288.
Yumiko Kato et al., "Prediction of Harsh 'rikimi' Voiced Mora in Emotional Speech," Technical Report of the Institute of Electronics Information and Communication Engineers, vol. 107, No. 282, SP2007-73, Oct. 18, 2007, pp. 13-18.
Carlos Toshinori Ishi et al., "Acoustic Analysis for Automatic Detection of Pressed Voice," Technical Report of the Institute of Electronics Information and Communication Engineers, vol. 106, No. 178, SP2006-27, Jul. 14, 2006, pp. 1-6.
Hiroshi Kanazawa et al., "Recognition and Synthesis of Nonverbal Utterances for Human-Computer Interaction," Journal of the Institute of Electronics Information and Communication Engineers D-II, vol. J77-D-II, No. 8, Aug. 25, 1994, pp. 1512-1521, (English Abstract).

* cited by examiner

*Primary Examiner* — James Wozniak
*Assistant Examiner* — Eve Klopf
(74) *Attorney, Agent, or Firm* — Wenderoth, Lind & Ponack, L.L.P.

(57) ABSTRACT

A strained-rough-voice conversion unit (10) is included in a voice conversion device that can generate a "strained rough" voice produced in a part of a speech when speaking forcefully with excitement, nervousness, anger, or emphasis and thereby richly express vocal expression such as anger, excitement, or an animated or lively way of speaking, using voice quality change. The strained-rough-voice conversion unit (10) includes: a strained phoneme position designation unit (11) designating a phoneme to be uttered as a "strained rough" voice in a speech; and an amplitude modulation unit (14) performing modulation including periodic amplitude fluctuation on a speech waveform. The amplitude modulation unit (14) generates, according to the designation of the strained phoneme position designation unit (11), the "strained rough" voice by performing the modulation including periodic amplitude fluctuation on the part to be uttered as the "strained rough" voice, in order to generate a speech having realistic and rich expression uttering forcefully with excitement, nervousness, anger, or emphasis.

21 Claims, 26 Drawing Sheets

FIG. 6

| Test Subject | Ratio of judgments that voice with fluctuated amplitude is more "strained" |
|---|---|
| 1 | 75 |
| 2 | 50 |
| 3 | 100 |
| 4 | 92 |
| 5 | 83 |
| 6 | 67 |
| 7 | 83 |
| 8 | 67 |
| 9 | 100 |
| 10 | 100 |
| 11 | 83 |
| 12 | 50 |
| 13 | 92 |
| 14 | 42 |
| 15 | 92 |
| 16 | 83 |
| 17 | 100 |
| 18 | 92 |
| 19 | 83 |
| 20 | 100 |

FIG. 24

あらゆる現実をすべて自分の方へ
(Arayuru genjitu o subete jibun no ho e)

<voice quality=strained rough voice>捻じ曲げたのだ</voice>
(nejimagetanoda)

(Every fact was manipulated for his/her own convenience.)

FIG. 25

あらゆる現実をすべて
(Arayuru genjitu o subete)

<voice quality=strained rough voice 5 moras>自分の方へ捻じ曲げたのだ</voice>
(jibun no ho e nejimagetanoda)

(Every fact was manipulated for his/her own convenience.)

STRAINED-ROUGH-VOICE CONVERSION DEVICE, VOICE CONVERSION DEVICE, VOICE SYNTHESIS DEVICE, VOICE CONVERSION METHOD, VOICE SYNTHESIS METHOD, AND PROGRAM

TECHNICAL FIELD

The present invention relates to technologies of generating "strained rough" voices having a feature different from that of normal utterances. Examples of the "strained rough" voice includes (i) a hoarse voice, a rough voice, and a harsh voice that are produced when, for example, a person yells, speaks forcefully with emphasis, and speaks excitedly or nervously, (ii) expressions such as "kobushi (tremolo or vibrato)" and "unari (growling or groaning voice)" that are produced in singing Enka (Japanese ballad) and the like, for example, and (iii) expressions such as "shout" that are produced in singing blues, rock, and the like. More particularly, the present invention relates to a voice conversion device and a voice synthesis device that can generate voices capable of expressing (i) emotion such as anger, emphasis, strength, and liveliness, (ii) vocal expression, (iii) an utterance style, or (iv) an attitude, situation, tension of a phonatory organ, or the like of a speaker, all of which are included in the above-mentioned voices.

BACKGROUND ART

Conventionally, voice conversion or voice synthesis technologies have been developed aiming for expressing emotion, vocal expression, attitude, situation, and the like using voices, and particularly for expressing the emotion and the like, not using verbal expression of voices, but using para-linguistic expression such as a way of speaking, a speaking style, and a tone of voice. These technologies are indispensable to speech interaction interfaces of electronic devices, such as robots and electronic secretaries.

Among para-linguistic expression of voices, various methods have been proposed to change prosody patterns. A method is disclosed to generate prosody patterns such as a fundamental frequency pattern, a power pattern, a rhythm pattern, and the like based on a model, and modify the fundamental frequency pattern and the power pattern using periodic fluctuation signals according to emotion to be expressed by voices, thereby generating prosody patterns of voices having the emotion to be expressed (refer to Patent Reference 1, for example). As described in paragraph [0118] of Patent Reference 1, the method of generating voices with emotion by modifying prosody patterns needs periodic fluctuation signals having cycles each exceeding a duration of a syllable in order to prevent voice quality change caused by variation.

On the other hand, for methods of achieving expression using voice quality, there have been developed: a voice conversion method of analyzing input voices to calculate synthetic parameters and changing the calculated parameters to change voice quality of the input voices (refer to Patent Reference 2, for example); and a voice synthesis method of generating parameters to be used to synthesize standard voices or voices without emotion and changing the generated parameters (refer to Patent Reference 3, for example).

Further, in technologies of speech synthesis using concatenation of speech waveforms, a technology is disclosed to previously synthesize standard voices or voices without emotion, select voices having feature vectors similar to those of the synthesized voices from among voices having expression such as emotion, and concatenates the selected voices to each other (refer to Patent Reference 4, for example).

Furthermore, in voice synthesis technologies of generating synthesis parameters using statistical learning models based on synthesis parameters generated by analyzing natural speeches, a method is disclosed to statistically learn a voice generation model corresponding to each emotion from the natural speeches including the emotion expressions, then prepare formulas for conversion between models, and convert standard voices or voices without emotion to voices expressing emotion.

Among the above-mentioned conventional methods, however, the technology having the synthesis parameter conversion performs the parameter conversion according to a uniform conversion rule that is predetermined for each emotion. This prohibits the technology from reproducing various kinds of voice quality such as voice quality having a partial strained rough voice which are produced in natural utterances.

In addition, in the above method of extracting voices with vocal expressions such as emotion having feature vectors similar to those of standard voices and concatenating the extracted voices to each other, voices having characteristic and special voice quality such as "strained rough voice" that is significantly different from voice quality of normal utterances are hardly selected. This prohibits the method from eventually reproducing various kinds of voice quality which are produced in natural utterances.

Moreover, in the above method of learning statistical voice synthesis models from natural speeches including emotion expressions, although there is a possibility of learning also variations of voice quality, voices having voice quality characteristic to express emotion are not frequently produced in the natural speeches, thereby making the learning of voice quality difficult. For example, the above-mentioned "strained rough voice", a whispery voice produced characteristically in speaking politely and gently, and a breathy voice that is also called a soft voice (refer to Patent References 4 and 5) are impressing voices having characteristic voice quality drawing attention of listeners and thereby significantly influence impression of a whole utterance. However, such a voice occurs in a portion of a whole real utterance, and occurrence frequency of such a voice is not high. Since a rate of a duration of such a voice to an entire utterance duration is low, models for reproducing "strained rough voice", "breathy voice", and the like are not likely to be learned in the statistical learning.

That is, the above-described conventional methods have problems of difficulty in reproducing variations of partial voice quality and impossibility of richly expressing vocal expression with texture, reality, and fine time structures.

In order to address the above problems, there is conceived a method of performing voice quality conversion especially for voices with characteristic voice quality so as to achieve the reproduction of variations of voice quality. As physical features (characteristics) of voice quality that are basis of the voice quality conversion, a "pressed ("rikimi" in Japanese)" voice having definition different from that of the "strained rough ("rikimi" in Japanese)" voice in this description, and the above-mentioned "breathy" voice are studied.

The "breathy voice" has features of: a low spectrum in harmonic components; and a great amount of noise components due to airflow. The above features of "breathy voice" result from that a glottis is opened in uttering a "breathy voice" more than in uttering a normal voice or a modal voice and that a "breathy voice" is a medium voice between a modal voice and a whisper. A modal voice has less noise components, and a whisper is a voice uttered only by noise components without any periodic components. The feature of "breathy voice" is detected as a low correlation between an envelope waveform of a first formant band and an envelope waveform of a third formant band, in other words, a low correlation between a shape of an envelope of band-pass signals having vicinity of the first formant band as a center and a shape of an envelope of band-pass signals having vicinity of the third formant band as a center. By adding the above feature to synthetic voice in voice synthesis, the "breathy" voice can be generated (refer to Patent Reference 5).

Moreover, as a "pressed voice" different from the "strained rough voice" in this description produced in an utterance in anger or excitement, a voice called "creaky" or "vocal fry" is studied. In this study, acoustic features of the "creaky voice" are: (i) significant partial change of energy; (ii) lower and less stable fundamental frequency than fundamental frequency of normal utterance; (iii) smaller power than that of a section of normal utterance. This study reveals that these features sometimes occur when a larynx is pressed to produce an utterance and thereby disturbs periodicity of vocal fold vibration. The study also reveals that a "pressed voice" often occurs in a duration longer than an average syllable-basis duration. The "breathy voice" is considered to have an effect of enhancing impression of sincerity of a speaker in emotion expression such as interest or hatred, or attitude expression such as hesitation or humble attitude. The "pressed voice" described in this study often occurs in (i) a process of gradually ceasing a speech generally in an end of a sentence, a phrase, or the like, (ii) ending of a word uttered to be extended in speaking while selecting words or in speaking while thinking, (iii) exclamation or interjection such as "well . . . " and "um . . . " uttered in having no ready answer. The study further reveals that each of the "creaky voice" and the "vocal fry" includes a diplophonia that causes a new period of a double beat or a double of a fundamental period. For a method of generating the diplophonia occurred in "vocal fry", there is disclosed a method of superposing voices with a phase being shifted from another by a half period of a fundamental frequency (refer to Patent Reference 6).

Patent Reference 1: Japanese Unexamined Patent Application Publication No. 2002-258886 (FIG. 8, paragraph [0118])

Patent Reference 2: Japanese Patent No. 3703394

Patent Reference 3: Japanese Unexamined Patent Application Publication No. 7-72900

Patent Reference 4: Japanese Unexamined Patent Application Publication No. 2004-279436

Patent Reference 5: Japanese Unexamined Patent Application Publication No. 2006-84619

Patent Reference 6: Japanese Unexamined Patent Application Publication No. 2006-145867

Patent Reference 7: Japanese Unexamined Patent Application Publication No. 3-174597

SUMMARY OF INVENTION

Problems that Invention is to Solve

Unfortunately, the above-described conventional methods fail to generate (i) a hoarse voice, a rough voice, or a harsh voice produced when speaking forcefully in excitement, nervousness, anger, or with emphasis, or (ii) a "strained rough" voice, such as "kobushi (tremolo or vibrato)", "unari (growling or groaning voice)", or "shout" in singing, that occurs in a portion of a speech. The above "strained rough" voice occurs when the utterance is produced forcefully and a phonatory organ is thereby strained more than usual utterances or tensioned strongly. The "strained rough" voice is uttered in a situation where the phonatory organ is likely to produce the "strained rough" voice. In more detail, since the "strained rough" voice is an utterance produced forcefully, (i) an amplitude of the voice is relatively large, (ii) a mora of the voice is a bilabial or alveolar sound and is also a nasalized or voiced plosive sound, and (iii) the mora is positioned somewhere between the first mora and the third mora in an accent phrase, rather than at an end of a sentence or a phrase. Therefore, the "strained rough" voice has voice quality that is likely to be uttered in a situation where the "strained rough" voice is occurred in a portion of a real speech. Further, such a "strained rough" voice occurs not only in exclamation and interjection, but also in various portions of speech regardless of whether the portion is an independent word or an ancillary word.

As explained above, the above-described conventional methods fail to generate the "strained rough" voice that is a target in this description. In other words, the above-described conventional methods have problems of difficulty in richly expressing vocal expression such as anger, excitement, nervousness, or an animated or lively way of speaking, using voice quality change by generating the "strained rough" voice which can express how a phonatory organ is strained and tensioned.

Thus, the present invention overcomes the problems of the conventional technologies as described above. It is an object of the present invention to provide a strained-rough-voice conversion device or the like that generates the above-mentioned "strained rough" voice at an appropriate position in a speech and thereby adds the "strained rough" voice in angry, excited, nervous, animated, or lively way of speaking or in singing voices such as Enka (Japanese ballad), blues, or rock, in order to achieve rich vocal expression.

Means to Solve the Problems

In accordance with an aspect of the present invention, there is provided a strained-rough-voice conversion device including: a strained phoneme position designation unit configured to designate a phoneme to be converted in a speech; and a modulation unit configured to perform modulation including periodic amplitude fluctuation with a period shorter than a duration of the phoneme, on a speech waveform expressing the phoneme designated by the strained phoneme position designation unit.

As described later, with the above structure, by performing modulation including periodic amplitude fluctuation on the speech waveform, the speech waveform can be converted to a strained rough voice. Thereby, the strained rough voice can be generated at an appropriate phoneme in the speech, which makes it possible to generate voices having rich expression realistically conveying (i) a strained state of a phonatory organ and (ii) texture of voices produced by reproducing a fine time structure.

It is preferable that the modulation unit is configured to perform the modulation including the periodic amplitude fluctuation with a frequency equal to or higher than 40 Hz on the speech waveform expressing the phoneme designated by the strained phoneme position designation unit.

It is further preferable that the modulation unit is configured to perform the modulation including the periodic amplitude fluctuation with a frequency in a range from 40 Hz to 120 Hz on the speech waveform expressing the phoneme designated by the strained phoneme position designation unit.

With the above structure, it is possible to generate natural voices which convey a strained state of a phonatory organ most easily and in which listeners hardly perceive artificial distortion. As a result, voices having rich expression can be generated.

It is still further preferable that the modulation unit is configured to perform the modulation including the periodic amplitude fluctuation on the speech waveform expressing the phoneme designated by the strained phoneme position designation unit, the periodic amplitude fluctuation being performed at a modulation degree in a range from 40% to 80% which represents a range of fluctuating amplitude in percentage.

With the above structure, it is possible to generate natural voices that convey a strained state of a phonatory organ most easily. As a result, voices having rich expression can be generated.

It is still further preferable that the modulation unit is configured to perform the modulation including the periodic amplitude fluctuation on the speech waveform, by multiplying the speech waveform by periodic signals.

With the above structure, it is possible to generate the strained rough voice using a quite simple structure, and also possible to generate voices having rich expression realistically conveying, as texture of the voices, a strained state of a phonatory organ, by reproducing a fine time structure.

It is still further preferable that the modulation unit includes: an all-pass filter shifting a phase of the speech waveform expressing the phoneme designated by the strained phoneme position designation unit; and an addition unit configured to add the speech waveform having the phase shifted by the all-pass filter, to the speech waveform expressing the phoneme designated by the strained phoneme position designation unit.

With the above structure, it is possible to vary a phase by varying amplitude, thereby generating voices using more natural modulation by which listeners hardly perceive artificial distortion. As a result, voices having rich emotion can be generated.

In accordance with another aspect of the present invention, there is provided a voice conversion device further including a receiving unit configured to receive a speech waveform; a strained phoneme position designation unit configured to designate a phoneme to be converted to a strained rough voice; and a modulation unit configured to perform modulation including periodic amplitude fluctuation with a period shorter than a duration of the phoneme on the speech waveform received by the receiving unit, according to the designation of the strained phoneme position designation unit to the phoneme to be converted to the strained rough voice.

It is preferable that the voice conversion device further includes: a phoneme recognition unit configured to recognize a phonologic sequence of the speech waveform; and a prosody analysis unit configured to extract prosody information from the speech waveform, wherein the strained phoneme position designation unit is configured to designate the phoneme to be converted to the strained rough voice, based on (i) the phonologic sequence recognized by the phoneme recognition unit regarding an input speech and (ii) the prosody information extracted by the prosody analysis unit.

With the above structure, a user can generate the strained rough voice at a desired phoneme in the speech so as to express vocal expression as the user desires. In other words, it possible to perform modulation including periodic amplitude fluctuation on the speech waveform, and thereby generate voices using the more natural modulation by which listeners hardly perceive artificial distortion. As a result, voices having rich emotion can be generated.

In accordance with still another aspect of the present invention, there is provided a strained-rough-voice conversion device including: a strained phoneme position designation unit configured to designate a phoneme to be converted in a speech; and a modulation unit configured to perform modulation including periodic amplitude fluctuation with a period shorter than a duration of the phoneme, on a sound source signal of a speech waveform expressing the phoneme designated by the strained phoneme position designation unit.

With the above structure, by performing modulation including periodic amplitude fluctuation on the sound source signals, the sound source signals can be converted to the strained rough voice. Thereby, it is possible to generate the strained rough voice at an appropriate phoneme in the speech, and possible to provide amplitude fluctuation to the speech waveform without changing characteristics of a vocal tract having slower movement than other phonatory organs. As a result, it is possible to generate voices having rich expression realistically conveying, as texture of the voices, a strained state of the phonatory organ, by reproducing a fine time structure.

It should be noted that the present invention can be implemented not only as the strained-rough-voice conversion device including the above characteristic units, but also as: a method including steps performed by the characteristic units of the strained-rough-voice conversion device: a program causing a computer to execute the characteristic steps of the method; and the like. Of course, the program can be distributed by a recording medium such as a Compact Disc-Read Only Memory (CD-ROM) or by a transmission medium such as the Internet.

Effects of the Invention

The strained-rough-voice conversion device or the like according to the present invention can generate a "strained rough" voice having a feature different from that of normal utterances, at an appropriate position in a converted or synthesized speech. Examples of the "strained rough" voice are: a hoarse voice, a rough voice, and a harsh voice that are produced when, for example, a person yells, speaks forcefully with emphasis, and speaks excitedly or nervously; expressions such as "kobushi (tremolo or vibrato)" and "unari (growling or groaning voice)" that are produced in singing Enka (Japanese ballad) and the like, and (iii) expressions such as "shout" that are produced in singing blues, rock, and the like. Thereby, the strained-rough-voice conversion device or the like according to the present invention can generate voices having rich expression realistically conveying, as texture of the voices, how much a phonatory organ of a speaker is tensed and strained, by reproducing a fine time structure.

Further, when modulation including periodic amplitude fluctuation is performed on a speech waveform, rich vocal expression can be achieved using simple processing. Furthermore, when modulation including periodic amplitude fluctuation is performed on a sound source waveform, it is possible to generate a more natural "strained rough" voice in which listeners hardly perceive artificial distortion, by using a modulation method which is considered to provide a state more similar to a state of uttering a real "strained rough" voice. Here, since phonemic quality is not damaged in real "strained rough" voices, it is supposed that features of "strained rough" voices are produced not in a vocal tract filter but in a portion related to a sound source. Therefore, the modulation of a sound source waveform is supposed to be processing that provides results more similar to the phenomenon of natural utterances.

BRIEF DESCRIPTION OF DRAWINGS

FIG. 6 is a table showing a ratio of judgments, which are made by each of twenty test subjects, that a voice with periodical amplitude fluctuation is a "strained rough voice".

FIG. 24 shows an example of an input text according to the modification of the fourth embodiment of the present invention.

FIG. 25 shows another example of the input text according to the modification of the fourth embodiment of the present invention.

NUMERICAL REFERENCES

Figure 1:
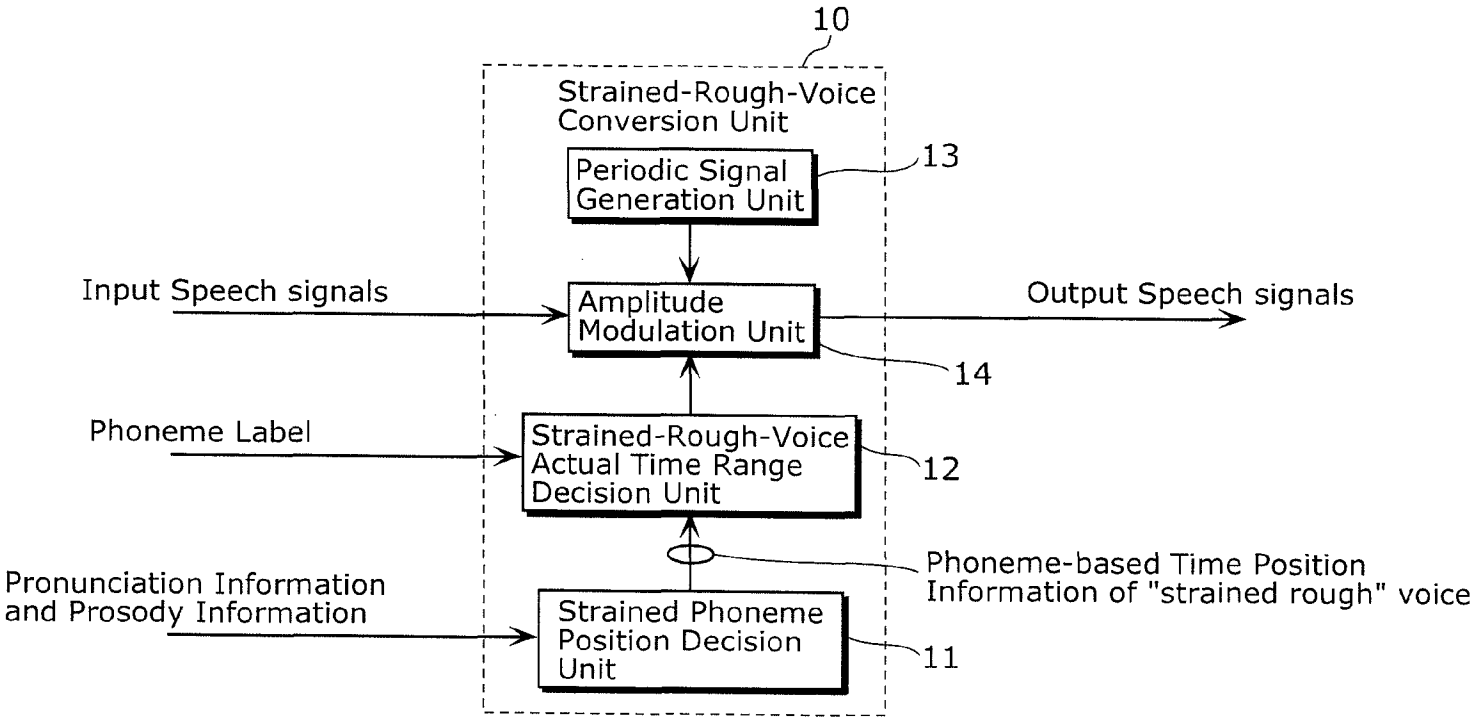
FIG. 1 is a block diagram showing a structure of a strained-rough-voice conversion unit included in a voice conversion device or a voice synthesis device according to a first embodiment of the present invention.

10, 20 strained-rough-voice conversion unit
11 strained phoneme position decision unit
12 strained-rough-voice actual time range decision unit
13 periodic signal generation unit
14 amplitude modulation unit
21 all-pass filter
22, 34, 45, 48 switch
23 adder
31 phoneme recognition unit
32 prosody analysis unit
33, 44 strained range designation input unit
40 text receiving unit
41 language processing unit
42 prosody generation unit
43 waveform generation unit
46 strained phoneme position designation unit
47 switch input unit
51 strained range designation obtainment unit

DETAILED DESCRIPTION OF THE INVENTION (First Embodiment)

Figure 2:
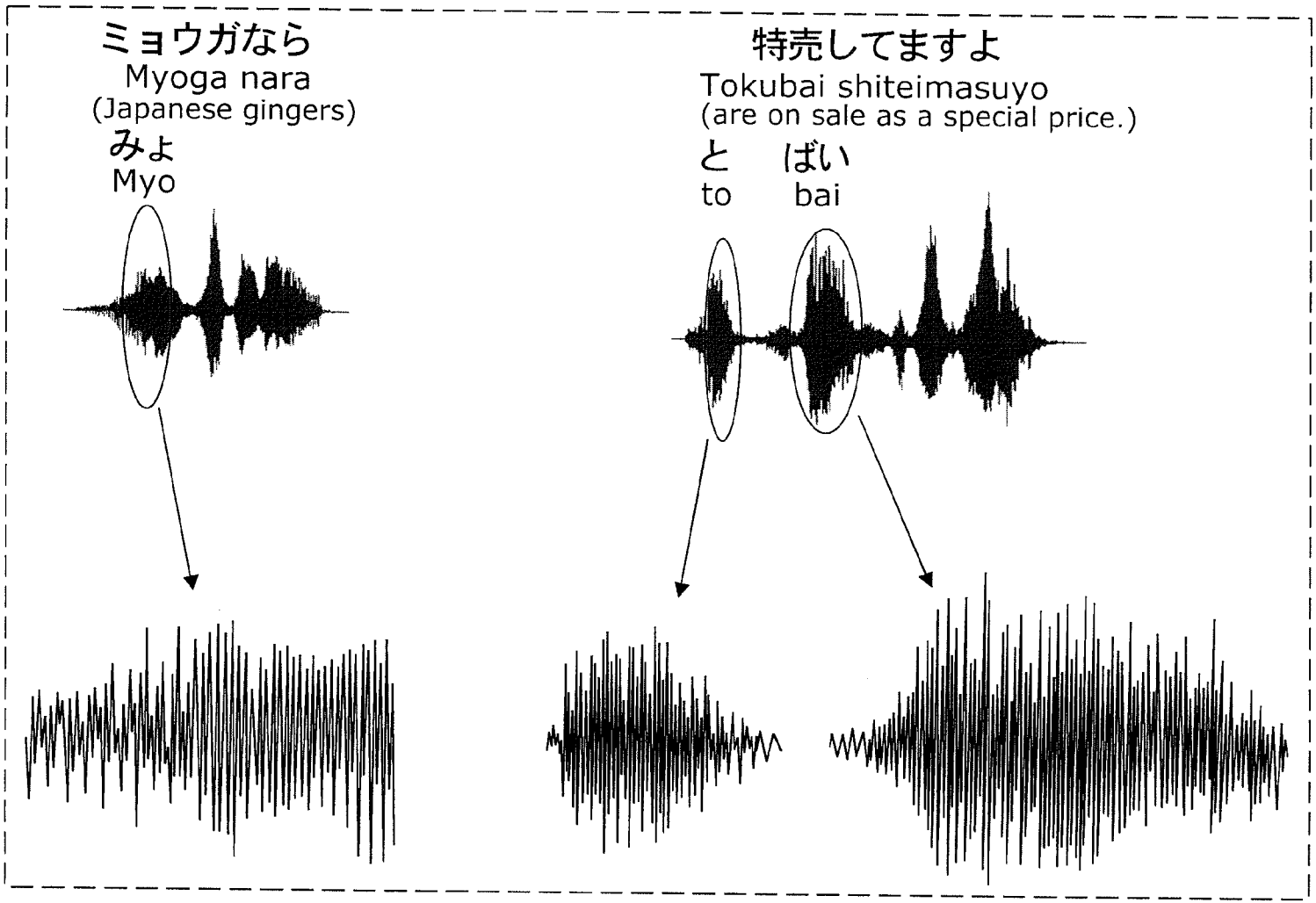
FIG. 2 is a diagram showing waveform examples of strained rough voices included in a real speech.
Figure 3A:
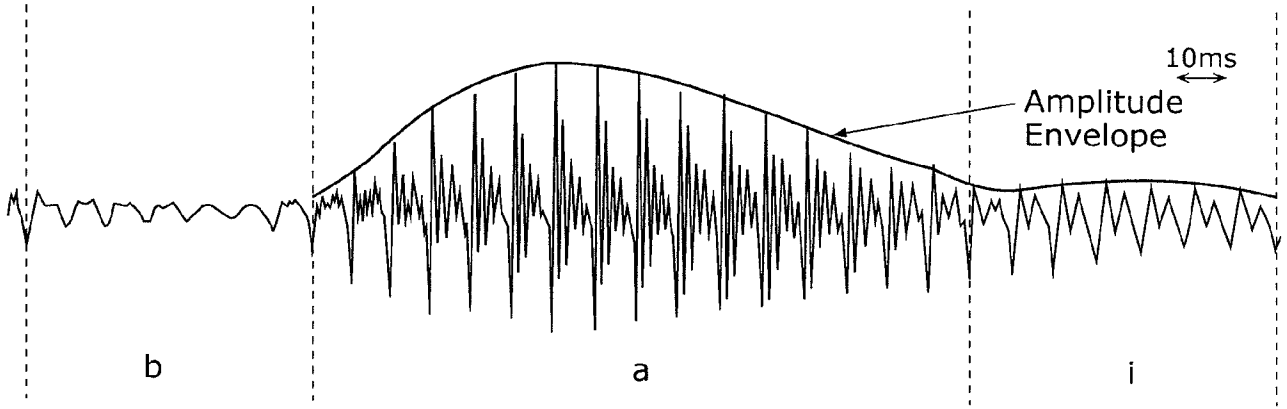
FIG. 3A is a diagram showing a waveform of non-strained voices included in a real speech, and a schematic shape of an envelope of the waveform.
Figure 3B:
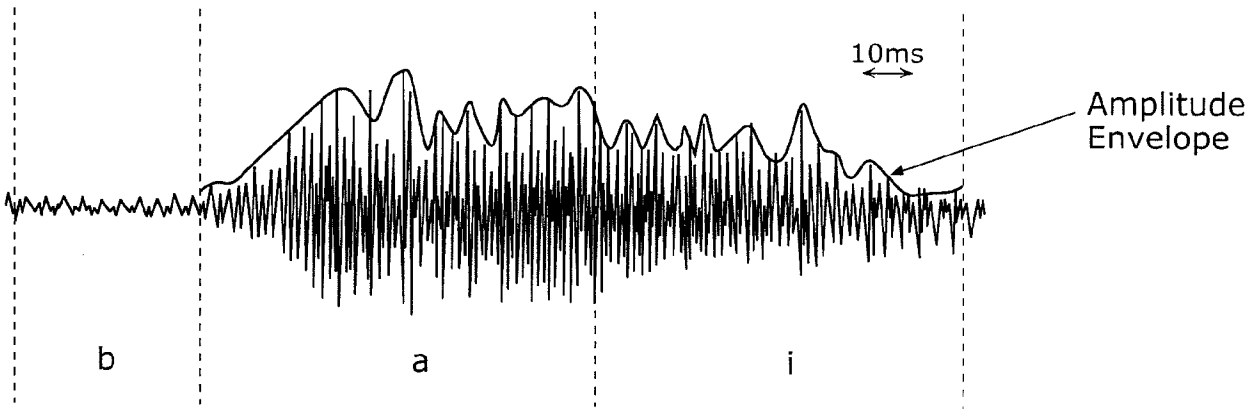
FIG. 3B is a diagram showing a waveform of strained rough voices included in a real speech, and a schematic shape of an envelope of the waveform.
Figure 4A:
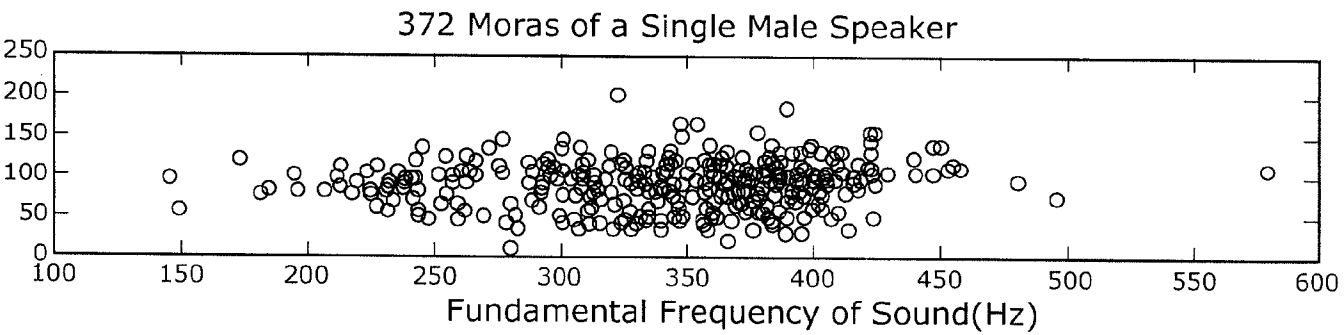
FIG. 4A is a scatter plot showing relationships between fundamental frequencies of strained rough voices included in real speeches and fluctuation frequency of amplitude regarding a male speaker.
Figure 4B:
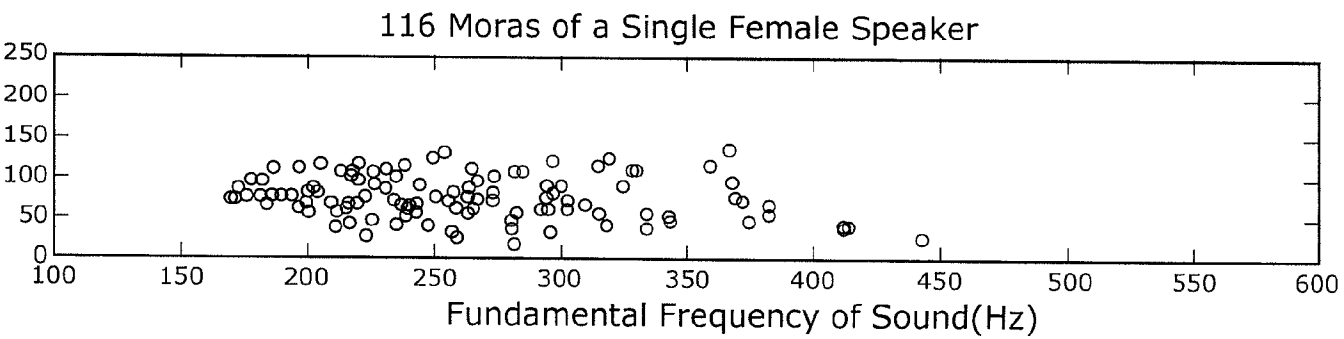
FIG. 4B is a scatter plot showing relationships between fundamental frequencies of strained rough voices included in real speeches and fluctuation frequency of amplitude regarding a female speaker.
Figure 5:
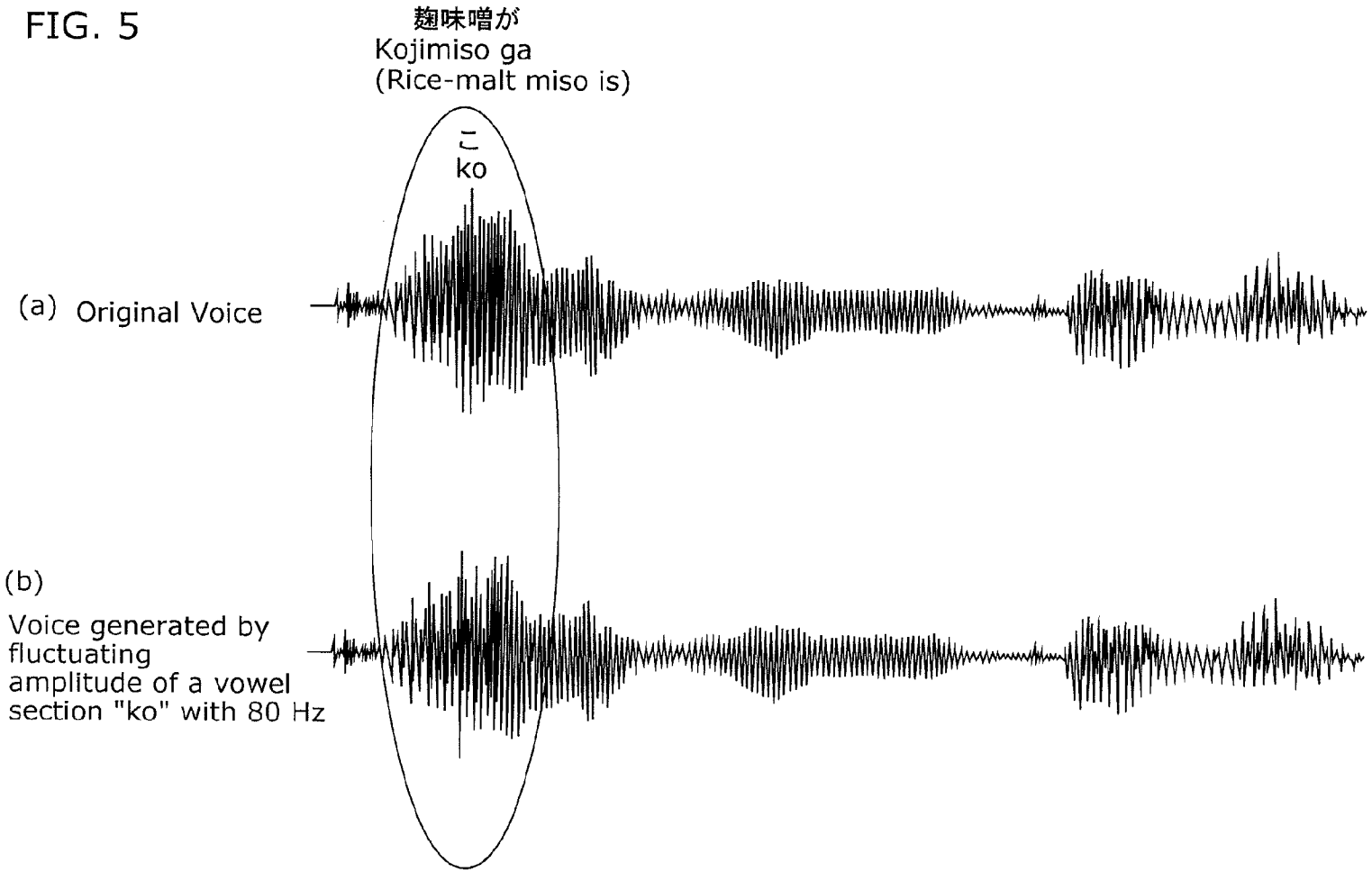
FIG. 5 is a diagram showing a waveform of a real speech and a waveform of a speech generated by performing amplitude fluctuation with a frequency of 80 Hz on the real speech.
Figure 7:
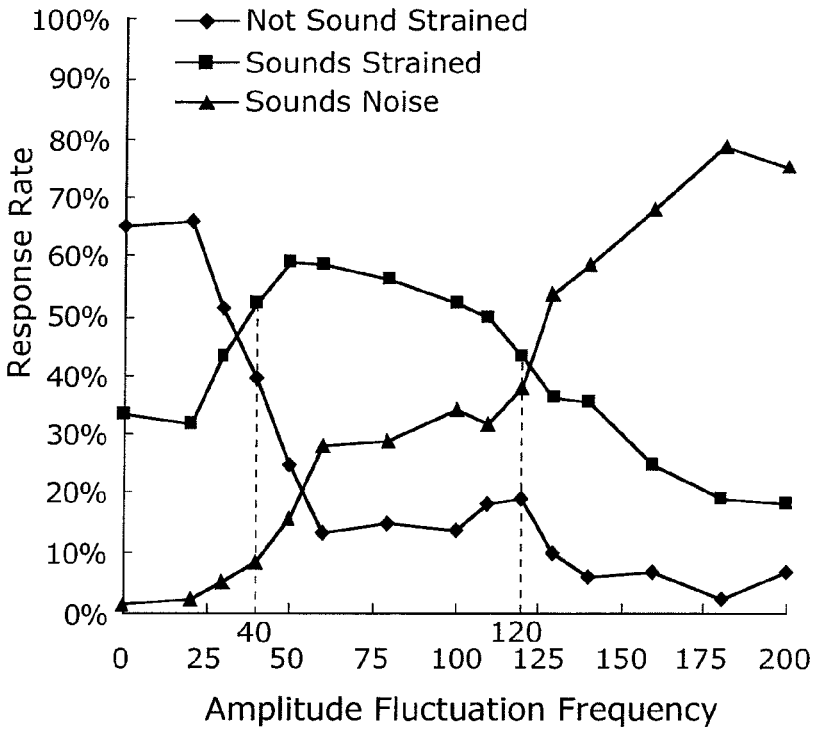
FIG. 7 is a graph plotting a range of amplitude fluctuation frequencies that are examined to sound "strained rough" voices in listening experiment.
Figure 8:
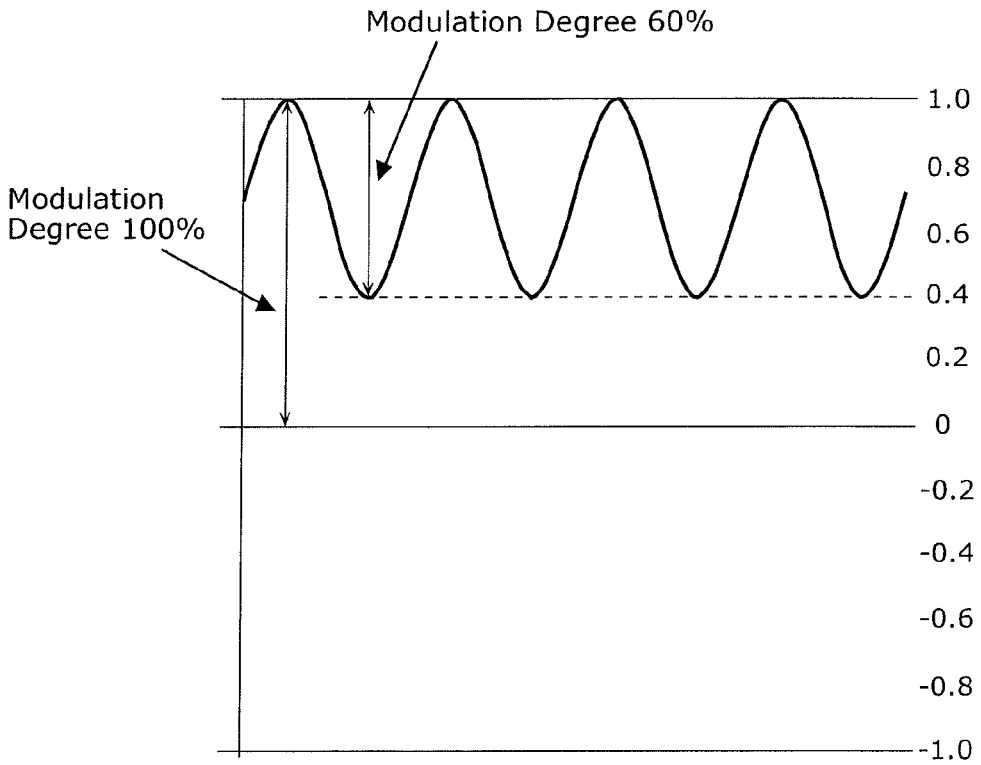
FIG. 8 is a graph for explaining modulation degrees of amplitude fluctuation.
Figure 9:
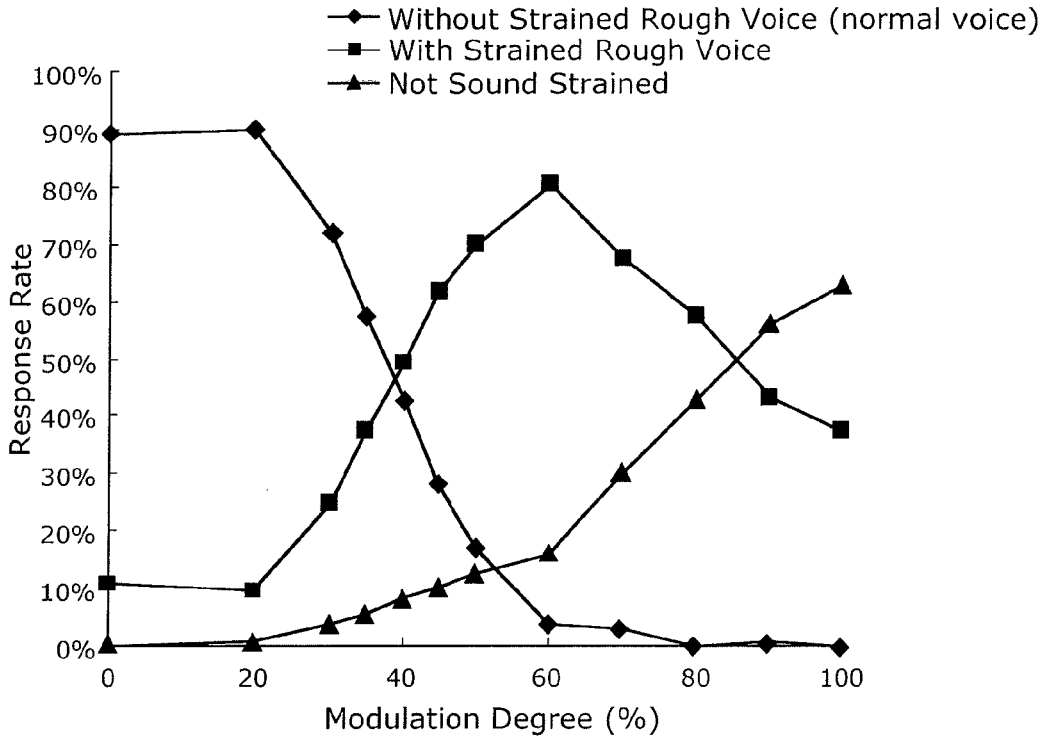
FIG. 9 is a graph plotting a range of modulation degrees of amplitude fluctuation that are examined to sound "strained rough" voices in listening experiment.
Figure 10:
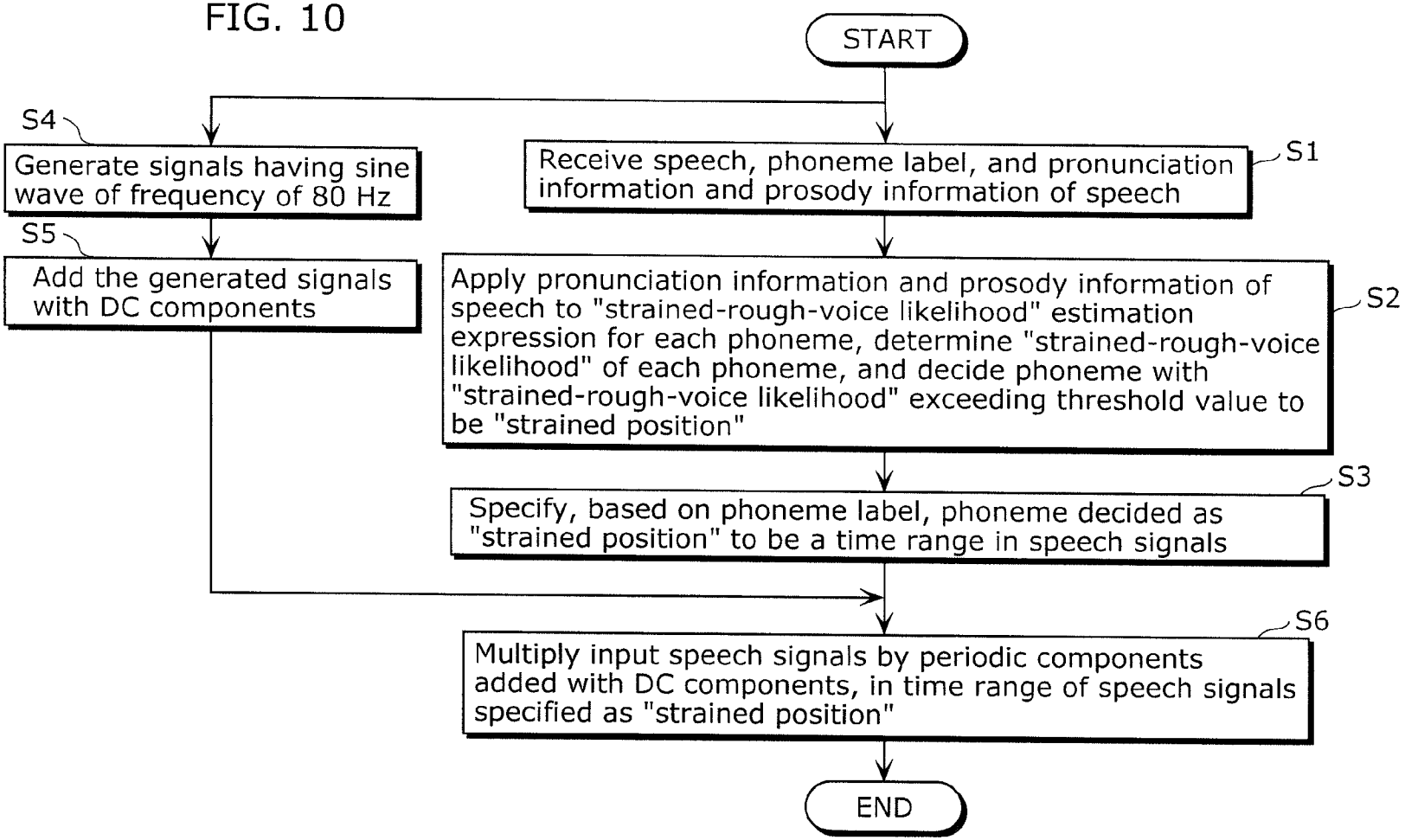
FIG. 10 is a flowchart of processing performed by the strained-rough-voice conversion unit included in the voice conversion device or the voice synthesis device according to the first embodiment of the present invention.

FIG. 1 is a functional block diagram showing a structure of a strained-rough-voice conversion unit that is a part of a voice conversion device or a voice synthesis device according to a first embodiment of the present invention. FIG. 2 is a diagram showing waveform examples of "strained rough" voices. FIG. 3A is a diagram showing a waveform of non-strained voices included in a real speech, and a schematic shape of an envelope of the waveform. FIG. 3B is a diagram showing a waveform of strained rough voices included in a real speech, and a schematic shape of an envelope of the waveform. FIG. 4A is a graph plotting distribution of fluctuation frequencies of amplitude envelopes of "strained rough" voices observed in real speeches of a male speaker. FIG. 4B is a graph plotting distribution of fluctuation frequencies of amplitude envelopes of "strained rough" voices observed in real speeches of a female speaker. FIG. 5 is a diagram showing an example of a speech waveform generated by performing "strained rough voice" conversion processing on a normally uttered speech. FIG. 6 is a table showing results of listening experience for comparing (i) voices on which the "strained rough voice" conversion processing has been performed with (ii) the normally uttered voices. FIG. 7 is a graph plotting a range of amplitude fluctuation frequencies that are examined to be sound "strained rough" voices in the listening experiment. FIG. 8 is a graph for explaining modulation degrees of amplitude fluctuation. FIG. 9 is a graph plotting a range of modulation degrees of amplitude fluctuation that are examined to sound "strained rough" voices in the listening experiment. FIG. 10 is a flowchart of processing performed by the strained-rough-voice conversion unit.

As shown in FIG. 1, a strained-rough-voice conversion unit 10 in the voice conversion device or the voice synthesis device according to the present invention is a processing unit that converts input speech signals to speech signals uttered as a strained rough voice. The strained-rough-voice conversion unit 10 includes a strained phoneme position decision unit 11, a strained-rough-voice actual time range decision unit 12, a periodic signal generation unit 13, and an amplitude modulation unit 14.

The strained phoneme position decision unit 11 receives pronunciation information and prosody information of a speech, determines based on the received pronunciation information and prosody information whether or not each phoneme in the speech is is to be uttered by a strained rough voice, and generates a time position information of the strained rough voice on a phoneme basis.

The strained-rough-voice actual time range decision unit 12 is a processing unit that receives (i) a phoneme label by which description of a phoneme of speech signals to be converted is associated with a real time position of the speech signals, and (ii) the time position information of the strained rough voice on a phoneme basis which is provided from the strained phoneme position decision unit 11, and decides a time range of the strained rough voice in an actual time period of the input speech signals based on the phoneme label and the time position information.

The periodic signal generation unit 13 is a processing unit that generates periodic fluctuation signals to be used to convert a normally uttered voice to a strained rough voice, and outputs the generated signals.

The amplitude modulation unit 14 is a processing unit that: receives (i) input speech signals, (ii) the information of the time range of the strained rough voice on an actual time axis of the input speech signals which is provided from the strained-rough-voice actual time range decision unit 12, and (iii) the periodic fluctuation signals provided from the periodic signal generation unit 13; generates a strained rough voice by multiplying a portion designated in the input speech signals by the periodic fluctuation signals; and outputs the generated strained rough voice.

Before describing processing performed by the strained-rough-voice conversion unit in the structure according to the first embodiment, the following describes the background of conversion to a "strained rough" voice by periodically fluctuating amplitude of normally uttered voices.

Here, prior to the following description of the present invention, it is assumed that research has previously performed for fifty sentences which have been uttered based on the same text, in order to examine voices without expression and voices with emotion. Regarding voices with emotion of "rage", "anger", and "cheerful and lively" among the above-mentioned voices with emotion, waveforms for each of which an amplitude envelope is periodically fluctuated as shown in FIG. 2 are observed in most of voices labeled as "strained rough voices" in listening experiment. FIG. 3A shows (i) a speech waveform of normal voices in a speech producing the same utterance as a portion "bai" in "Tokubai shiemasuyo (. . . is on sale as a special price)" calmly without any emotion, and (ii) a schematic shape of an envelope of the waveform. On the other hand, FIG. 3B shows (i) a waveform of the same portion "bai" uttered with emotion of "rage" as shown in FIG. 2, and (ii) a schematic shape of an envelope of the waveform. For each of the waveforms, a boundary between phonemes is shown by a broken line. In portions uttering "a" and "i" in the waveform of FIG. 3A, it is observed that amplitude is fluctuated smoothly. In normal utterances, as shown in the waveform of FIG. 3A, amplitude is smoothly increased from a rise of a vowel, then has its peak at an around center of the phoneme, and is decreased gradually towards a phoneme boundary. If a vowel decays, amplitude is smoothly decreased towards amplitude of silence or a consonant following to the vowel. If a vowel follows a vowel as shown in FIG. 3A, amplitude is gradually decreased or increased towards amplitude of the following vowel. In normal utterances, repetition of increase and decrease of amplitude in a signal vowel as shown in FIG. 3B is hardly observed, and no report shows voices having such amplitude fluctuation in which relationship with a fundamental frequency is not certain. Therefore, in this description, assuming that "amplitude fluctuation" is a feature of a "strained rough", a fluctuation period of an amplitude envelope of a voice labeled as a "strained rough" voice is determined by the following processing.

Firstly, in order to extract a sine wave component representing speech waveforms, band-pass filters each having as a central frequency the second harmonic of a fundamental frequency of a speech waveform to be processed are formed sequentially, and each of the formed filters filters the corresponding speech waveform. Hilbert transformation is performed on the filtered speech waveform to generate analytic signals, and a Hilbert envelope is determined using an absolute value of the generated analytic signals thereby determining an amplitude envelope of the speech waveform. Hilbert transformation is further performed on the determined amplitude envelope, then an instant angular velocity is calculated for each sample point, and based on a sampling period the calculated angular velocity is converted to a frequency. A histogram is created for each phoneme regarding an instantaneous frequency determined for each sample point, and a mode value is assumed to be a fluctuation frequency of an amplitude envelope of a speech waveform of the corresponding phoneme.

FIGS. 4A and 4B are graphs each plotting (i) a fluctuation frequency of an amplitude envelope of each phoneme of a "strained rough" voice determined by the above method, verses (ii) an average fundamental frequency of the phoneme, regarding a male speaker and a female speaker, respectively. Regardless of a fundamental frequency, in the both cases of the male and female speakers, a fluctuation frequency of an amplitude envelope is distributed within a range from 40 Hz to 120 Hz having a center of 80 Hz to 90 Hz. These graphs show that one of features of a "strained rough" voice is periodic amplitude fluctuation in a frequency band ranging from 40 Hz to 120 Hz.

Based on the observation, as shown in waveform examples of FIG. 5, modulation including periodic amplitude fluctuation with a frequency of 80 Hz is performed on normally uttered speech (voices) in order to execute listening experiment for examining whether or not a voice having the modulated waveform (hereinafter, referred to also as a "modulated voice") as shown in FIG. 5 (*b*) sounds strained more than a voice having the non-modulated waveform (hereinafter, referred to also as a "non-modulated voice") as shown in FIG. 5(*a*). In listening experiment, each of twenty test subjects compares twice (i) each of six different modulated voices to (ii) a non-modulated voice. Results of the comparison are shown in FIG. 6. A ratio of judgment that the voice applied with modulation including amplitude fluctuation with a frequency of 80 Hz sounds more strained is 82% in average and 100% in maximum, and has a standard deviation of 18%. The results show that a normal voice can be converted to a "strained rough" voice by performing the modulation including periodic amplitude fluctuation with a frequency of 80 Hz on the normal voice.

Another listening experiment is executed to examine a range of an amplitude fluctuation frequency which sounds a "strained rough" voice. In the experiment, modulation including periodic amplitude fluctuation is previously performed on each of three normally uttered voices with respective frequencies of fifteen stages from no amplitude fluctuation to 200 Hz, and each of the modulated voices is classified into a corresponding one of the following three categories. More specifically, each of thirteen test subjects having normal hearing ability selects "Not Sound Strained" when a voice sounds like a normal voice, selects "Sounds Strained" when the voice sounds a "strained rough" voice, and selects "Sounds Noise" when amplitude fluctuation makes the voice heard different and thereby the voice does not sound a "strained rough voice". The selection is judged twice for each voice. As shown in FIG. 7, results of the experiment show that; up to amplitude fluctuation frequency of 30 Hz in amplitude fluctuation, most of answers is "Not Sound Strained"; in a range from amplitude fluctuation frequency of 40 Hz to 120 Hz, most of answers is "Sounds Strained"; and regarding amplitude fluctuation frequency of 130 Hz and more, most of answers is "Sounds Noise". This shows that a range of amplitude fluctuation frequencies with which a voice is likely to be perceived as a "strained rough" voice is from 40 Hz to 120 Hz that is similar to the distribution of amplitude fluctuation frequencies of real "strained rough" voices.

On the other hand, since a modulation degree of amplitude fluctuation is slow gradually fluctuating amplitude of each phoneme in a speech waveform, the above amplitude fluctuation is different from commonly-known amplitude modulation of modulating a constant amplitude of carrier signals. However, modulation signals in this description are assumed to have the same amplitude modulation as that of carrier signals having a constant amplitude, as shown in FIG. 8. Here, a modulation degree is represented by a modulation range of modulation signals in percentage, assuming the modulation degree is 100% when an amplitude absolute value of signals to be modulated is modulated within a range from 1.0 times (namely, no amplitude modulation) to 0 times (namely, amplitude of zero). In the modulation signals shown in FIG. 8, signals to be modulated are modulated from no amplitude fluctuation (1.0 times) to 0.4 times. Thereby, a modulation range is from 1.0 to 0.4, in other words, 0.6. Therefore, a modulation degree is expressed as 60%. Still another listening experiment is performed to examine a range of a modulation degree at which a voice sounds a "strained rough" voice. Modulation including periodic amplitude fluctuation is previously performed on each of two normally uttered voices at modulation degrees varying from 0% (namely, no amplitude fluctuation) to 100% thereby generating voices of twelve stages. In the listening experiment, each of fifteen test subjects having normal hearing ability listens to audio data, and then from among three categories selects: "Without Strained Rough Voice" when the data sounds like a normal voice; "With Strained Rough Voice" when the data sounds a "strained rough" voice; and "Not Sound Strained" when the data sounds an unnatural voice except a strained rough voice. The selection is judged five times for each voice. As shown in FIG. 9, results of the listening experiment show that; in a range of modulation degrees from 0% to 35%, most of answers is "Without Strained Rough Voice"; and in a range of modulation degrees from 40% to 80%, most of answers is "With Strained Rough Voice". Further, at modulation degrees of 90% and more, most of answers is that the data sounds an unnatural voice except a strained rough voice, namely, "Not Sound Strained". This shows that a range of modulation degrees at which a voice is likely to be perceived as a "strained rough" voice is from 40% to 80%.

Next, the processing performed by the strained-rough-voice conversion unit 10 having the above-described structure is described with reference to FIG. 10. Firstly, the strained-rough-voice conversion unit 10 receives speech signals of a speech (or voices), a phoneme label, and pronunciation information and prosody information of the speech (Step S1). The "phoneme label" is information in which description of each phoneme is associated with a corresponding actual time position in the speech signals. The "pronunciation information" is a phonologic sequence indicating a content of an utterance of the speech. The "prosody information" includes at least a part of information that indicates a physical quantity of the speech signals indicating descriptive prosody information. The descriptive prosody information includes: descriptive prosody information such as an accent phrase, a phrase, and pose; and descriptive prosody information such as a fundamental frequency, amplitude, power, and a duration. Here, the speech signals are provided to the amplitude modulation unit 14, the phoneme label is provided to the strained-rough-voice actual time range decision unit 12, and the pronunciation information and the prosody information of the speech are provided to the strained phoneme position decision unit 11.

Next, the strained phoneme position decision unit 11 applies the pronunciation information and the prosody information to a strained-rough-voice likelihood estimation rule, in order to determine a likelihood indicating how a phoneme is likely to sound a strained rough voice (hereinafter, referred to as a "strained-rough-voice likelihood"). Then, if the determined strained-rough-voice likelihood exceeds a predetermined threshold value, the strained phoneme position decision unit 11 decides that the phoneme is to be a position of a strained rough voice (hereinafter, referred to as a "strained position") (Step S2). The estimation rule used in Step S2 is, for example, an estimation expression that is previously generated by statistical learning using a voice database holding strained rough voices. Such estimation rule is disclosed by the same inventors as those of the present invention in Patent Reference, International Patent Publication No. WO/2006/123539. An example of the statistical learning techniques is that an estimation expression is learned using Quantification Method II where (i) independent variables are a phoneme kind of a target phoneme, a phoneme kind of a phoneme immediately prior to the target phoneme, a phoneme kind of a phoneme immediately subsequent to the target phoneme, a distance between the target phoneme and an accent nucleus, a position of the target phoneme in an accent phrase, and the like, and (ii) a dependent variable represents whether or not the target phoneme is uttered by a strained rough voice.

The strained-rough-voice actual time range decision unit 12 examines a relationship between (i) the strained position decided by the strained phoneme position decision unit 11 on a phoneme basis and (ii) the phoneme label. Thereby, time position information of a strained rough voice on a phoneme basis is specified as a time range of the strained rough voice in the speech signals (Step S3).

On the other hand, the periodic signal generation unit 13 generates signals having a sine wave having a frequency of 80 Hz (Step S4), and then adds the generated signals with direct current (DC) components to generate signals (Step S5).

For the actual time range specified in the speech signals as a "strained position", the amplitude modulation unit 14 performs amplitude modulation by multiplying the input speech signals by periodic signals generated by the periodic signal generation unit 13 to vibrate with a frequency of 80 Hz (Step S6), in order to convert a voice at the actual time range to a strained rough voice including periodic amplitude fluctuation with a period shorter than a duration of a phoneme of the voice.

With the above structure and method, it is decided, using information of each phoneme and based on an estimation rule, whether or not each phoneme is to be a strained position, and only the phoneme estimated as a strained position is modulated by performing modulation including periodic amplitude fluctuation with a period shorter than a duration of the phoneme, thereby producing a "strained rough" voice at an appropriate position. Thereby, it is possible to generate voices with realistic emotion having texture such as anger, excitement, or nervousness, an animated or lively way of speaking, or the like in which listeners perceive a degree of tension of a phonatory organ, by reproducing a fine time structure.

It should be noted that it has been described that at Step S4 the periodic signal generation unit 13 generates signals having a sine wave having a frequency of 80 Hz, but the frequency may be any frequency in a range from 40 Hz to 120 Hz according to distribution of fluctuation frequency of an amplitude envelope, and the periodic signals may be periodic signals not having a sine wave.

(Modification of First Embodiment)

Figure 11:
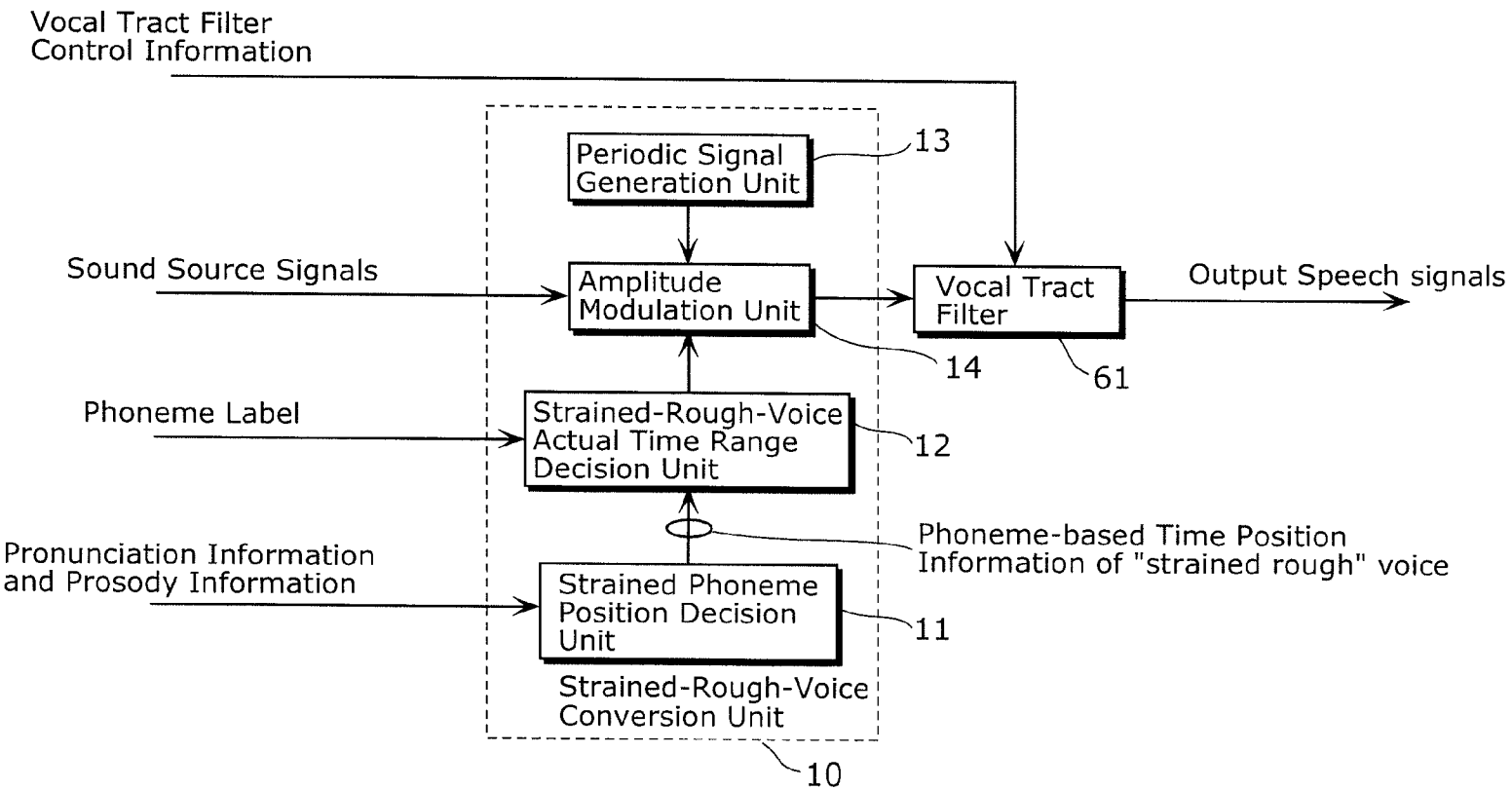
FIG. 11 is a functional block diagram of a modification of the strained-rough-voice conversion unit of the first embodiment of the present invention.
Figure 12:
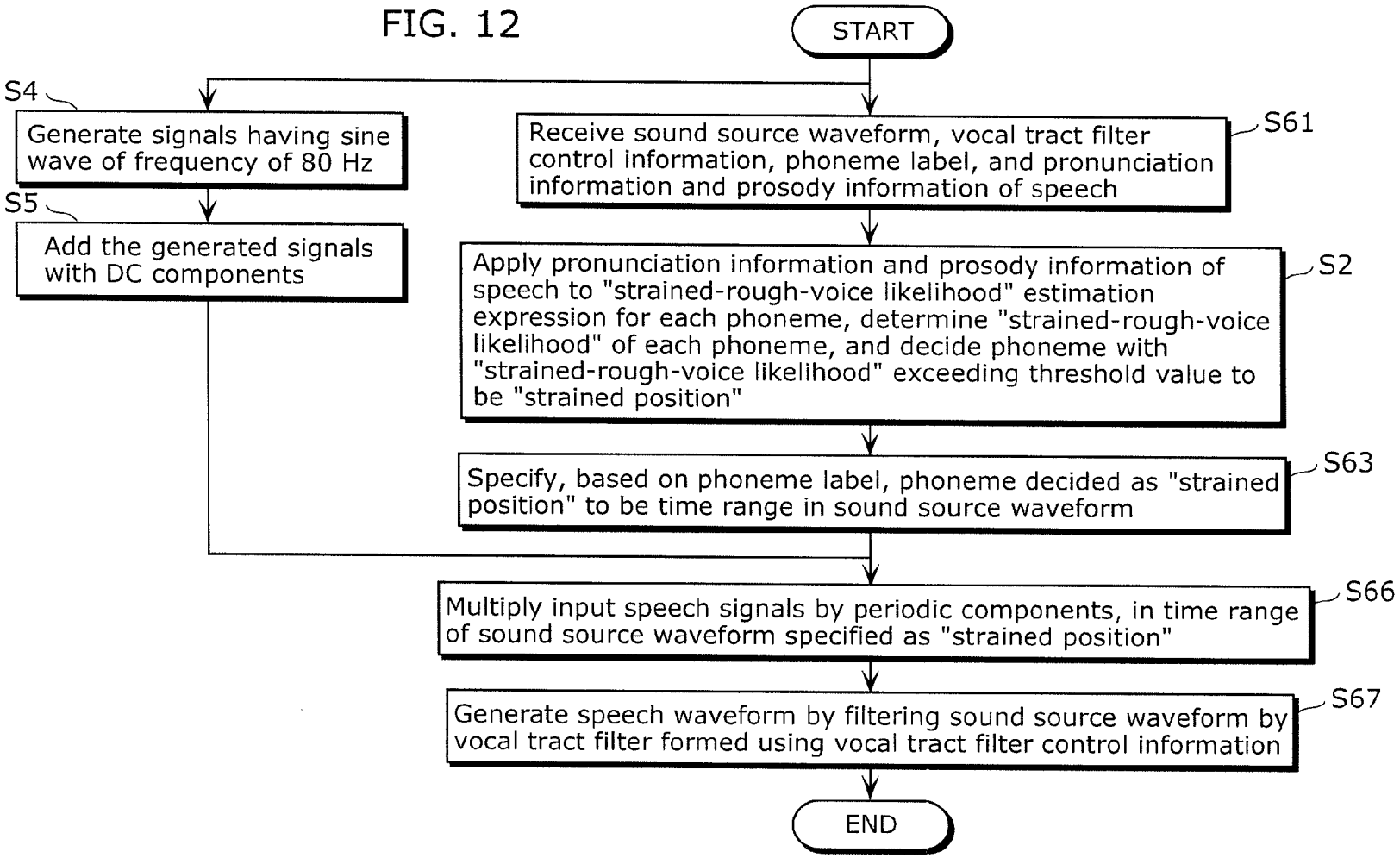
FIG. 12 is a flowchart of processing performed by the modification of the strained-rough-voice conversion unit of the first embodiment of the present invention.

FIG. 11 is a functional block diagram of a modification of the strained-rough-voice conversion unit of the first embodiment of the present invention. FIG. 12 is a flowchart of processing performed by the modification of the strained-rough-voice conversion unit of the first embodiment of the present invention. The same reference numerals of FIGS. 1 and 10 are assigned to the identical units of FIG. 11, so that the identical units are not explained again below.

As shown in FIG. 11, a structure of the strained-rough-voice conversion unit 10 according to the present modification is similar to the structure of the strained-rough-voice conversion unit 10 of FIG. 1 in the first embodiment, but differs from the first embodiment in receiving a sound source waveform as an input, not speech signals in the first embodiment. For the difference, a voice conversion device or a voice synthesis device according to this modification of the first embodiment further includes a vocal tract filter 61 that filters the received sound source waveform to generate a speech waveform.

The processing performed by the strained-rough-voice conversion unit 10 and the vocal tract filter 61 having the above-described structure is described with reference to FIG. 12. Firstly, the strained-rough-voice conversion unit 10 receives a sound source waveform, a phoneme label, and pronunciation information and prosody information of a speech of the sound source waveform (Step S61). Here, the sound source waveform is provided to the amplitude modulation unit 14, the phoneme label is provided to the strained-rough-voice actual time range decision unit 12, and the pronunciation information and the prosody information of the speech are provided to the strained phoneme position decision unit 11. Furthermore, vocal tract filter control information is provided to the vocal tract filter 61. Next, the strained phoneme position decision unit 11 applies the pronunciation information and the prosody information to a strained-rough-voice likelihood estimation rule to determine a strained-rough-voice likelihood of a phoneme. Then, if the determined strained-rough-voice likelihood exceeds a predetermined threshold value, the strained phoneme position decision unit 11 decides that the phoneme is to be a strained position (Step S2). The strained-rough-voice actual time range decision unit 12 examines a relationship between (i) a strained position decided for each phoneme by the strained phoneme position decision unit 11 and (ii) the phoneme label, and thereby specifies a time position information of a strained rough voice for each phoneme as a time range in the sound source waveform (Step S63). On the other hand, the periodic signal generation unit 13 generates signals having a sine wave having a frequency of 80 Hz (Step S4), and then adds the generated signals with DC components to generate signals (Step S5). For the actual time range which is in the sound source waveform and specified as a "strained position", the amplitude modulation unit 14 performs amplitude modulation by multiplying the sound source waveform by periodic signals generated by the periodic signal generation unit 13 to vibrate with a frequency of 80 Hz (Step S66). The vocal tract filter 61 receives, as an input, information for controlling a vocal tract filter corresponding to the sound source waveform received by the strained-rough-voice conversion unit 10 (for example, a mel-cepstrum coefficient sequence for each analysis frame, or a center frequency, a bandwidth and the like of the filter for each unit time), and then forms a vocal tract filter corresponding to the sound source waveform provided from the amplitude modulation unit 14. The sound source waveform provided from the amplitude modulation unit 14 passes through the vocal tract filter 61 to be generated as a speech waveform (Step S67).

As described in the first embodiment, with the above structure, by generating a "strained rough" voice at an appropriate position, it is possible to generate voices with realistic emotion having texture such as anger, excitement, or nervousness, an animated or lively way of speaking, or the like in which listeners perceive a degree of tension of a phonatory organ, by reproducing a fine time structure. In addition, based on observation that actual "strained rough" voices are uttered without vibrating a mouth or lips and phonemic quality is not damaged significantly, the amplitude fluctuation is supposed to be produced in a sound source or a portion closer to the sound source. Therefore, by modulating a sound source waveform not a vocal tract filter mainly related to a shape of a mouth or lips, it is possible to generate a natural "strained rough" voice which is similar to phenomenon of actual utterances and in which listeners hardly perceive artificial distortion. Here, the phonemic quality means a state having various acoustic features represented by a spectrum structure characteristically observed in each phoneme and a time transient pattern of the spectrum structure. The damage on phonemic quality means a state where each phoneme loses such acoustic features and is beyond a range in which the phoneme can sound distinguished from another.

It should be noted that it has been described for Step S4 that the periodic signal generation unit 13 generates signals having a sine wave having a frequency of 80 Hz, but the frequency may be any frequency in a range from 40 Hz to 120 Hz according to distribution of fluctuation frequency of an amplitude envelope, and the signals generated by the periodic signal generation unit 13 may be periodic signals not having a sine wave.

(Second Embodiment)

Figure 13:
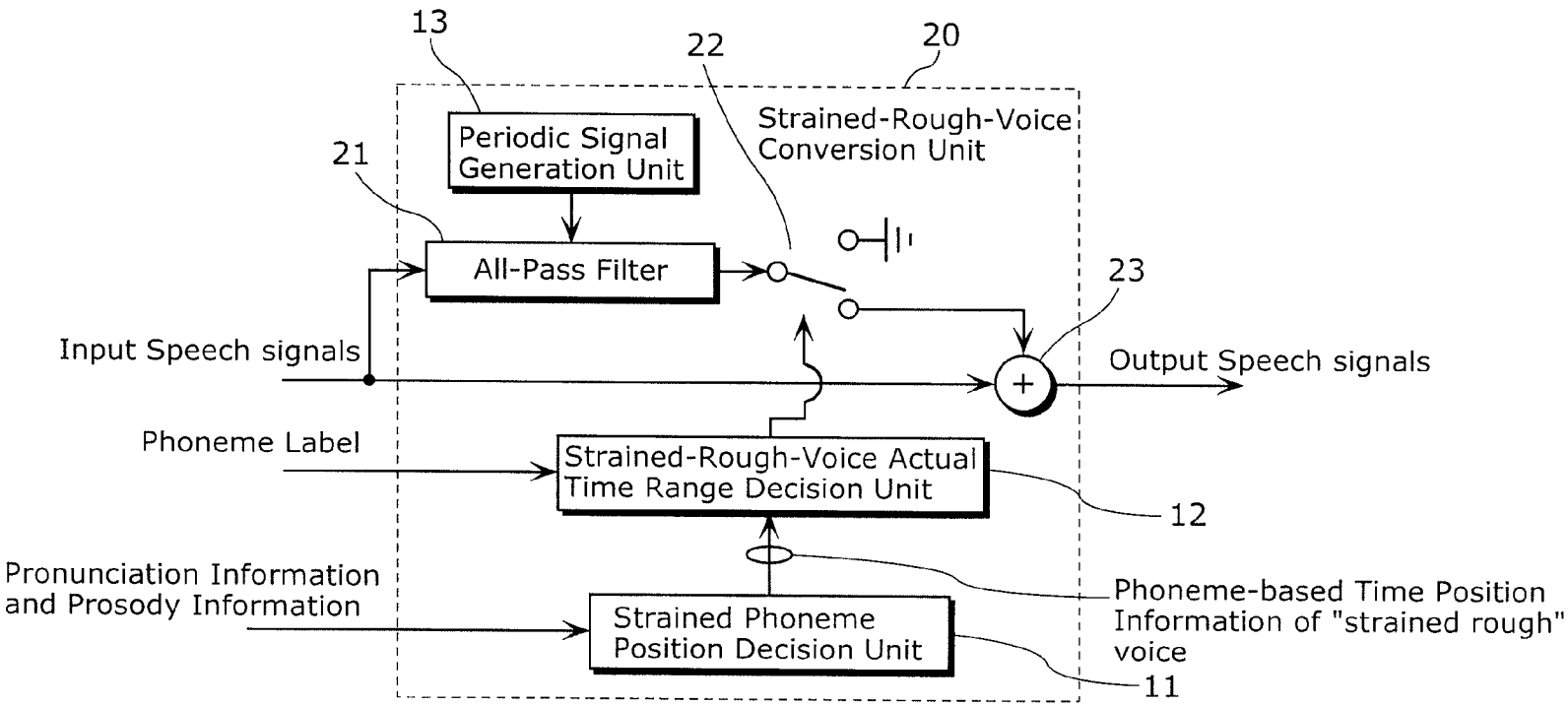
FIG. 13 is a block diagram showing a structure of a strained-rough-voice conversion unit included in a voice conversion device or a voice synthesis device according to a second embodiment of the present invention.
Figure 14:
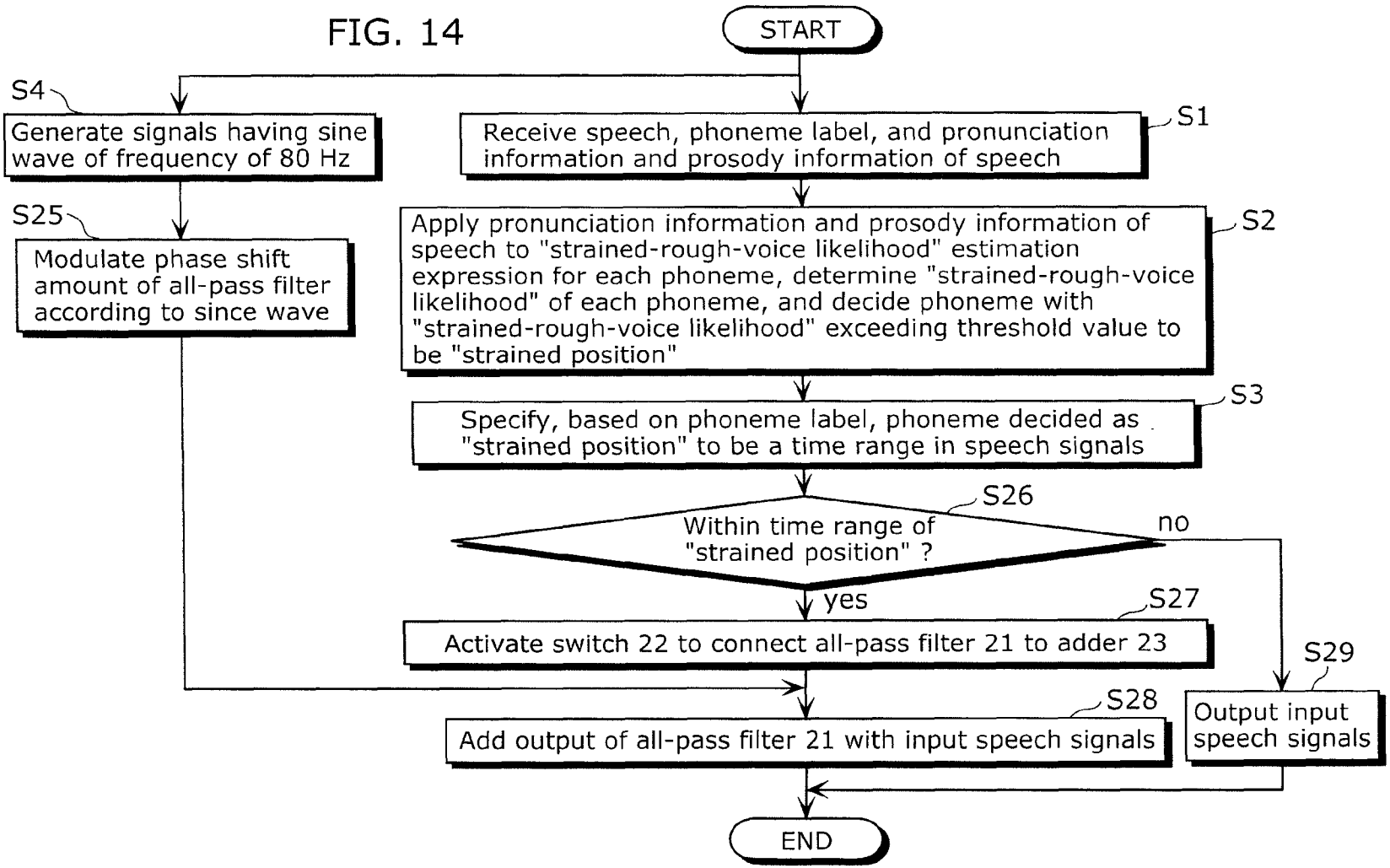
FIG. 14 is a flowchart of processing performed by the strained-rough-voice conversion unit included in the voice conversion device or the voice synthesis device according to the second embodiment of the present invention.

FIG. 13 is a block diagram showing a structure of a strained-rough-voice conversion unit included in a voice conversion device or a voice synthesis device according to a second embodiment of the present invention. FIG. 14 is a flowchart of processing performed by the strained-rough-voice conversion unit according to the second embodiment. The same reference numerals and step numerals of FIGS. 1 and 10 are assigned to the identical units of FIGS. 13 and 14, so that the identical units and steps are not explained again below.

As shown in FIG. 13, a strained-rough-voice conversion unit 20 in the voice conversion device or the voice synthesis device according to the present invention is a processing units that converts input speech signals to speech signals uttered by strained rough voices. The strained-rough-voice conversion unit 10 includes the strained phoneme position decision unit 11, the strained-rough-voice actual time range decision unit 12, the periodic signal generation unit 13, an all-pass filter 21, a switch 22, and an adder 23.

The strained phoneme position decision unit 11 and the strained-rough-voice actual time range decision unit 12 in FIG. 13 are the same as the strained phoneme position decision unit 11 and the strained-rough-voice actual time range decision unit 12 in FIG. 1, respectively, so that they are not explained again below.

The periodic signal generation unit 13 is a processing unit that generates periodic fluctuation signals.

The all-pass filter 21 is a filter that has a constant amplitude response but has a variable phase response depending on frequency. In the fields of the electric communication the all-pass filter is used to compensate delay characteristics of a transmission path. In the fields of electronic musical instruments the all-pass filter is used in an effector (device adding change and effects to sound) called a phasor or a phase shifter (Non-Patent Document: "Konpyuta Ongaku-Rekishi, Tekunorogi, Ato (The Computer Music Tutorial)", Curtis Roads, translated and edited by Aoyagi Tatsuya et al., Tokyo Denki University Press, page 353). The all-pass filter 21 according to the second embodiment has characteristics of a variable phase shift amount.

According to an input of the strained-rough-voice actual time range decision unit 12, the switch 22 switches (selects) whether or not an output of the all-pass filter 21 is to be provided to the adder 23.

The adder 23 is a processing unit that adds output signals of the all-pass filter 21 with the input speech signals.

Next, processing performed by the strained-rough-voice conversion unit 20 having the above-described structure is described with reference to FIG. 14.

Firstly, the strained-rough-voice conversion unit 20 receives speech signals of a speech (or voices), a phoneme label, and pronunciation information and prosody information of the speech (Step S1). Here, the phoneme label is provided to the strained-rough-voice actual time range decision unit 12, and the pronunciation information and the prosody information of the speech are provided to the strained phoneme position decision unit 11. Furthermore, the speech signals are provided to the adder 23.

Next, in the same manner as described in the first embodiment, the strained phoneme position decision unit 11 applies the pronunciation information and the prosody information to a strained-rough-voice likelihood estimation rule to determine a strained-rough-voice likelihood of a phoneme, and if the determined strained-rough-voice likelihood exceeds a predetermined threshold value, decides that the phoneme is to be a strained position (Step S2).

The strained-rough-voice actual time range decision unit 12 examines a relationship between (i) the strained position decided by the strained phoneme position decision unit 11 on a phoneme basis and (ii) the phoneme label. Thereby, time position information of a strained rough voice on a phoneme basis is specified as a time range of the strained rough voice in the speech signals (Step S3), and a switch signal is provided from the strained-rough-voice actual time range decision unit 12 to the switch 22.

On the other hand, the periodic signal generation unit 13 generates signals having a sine wave having a frequency of 80 Hz (Step S4), and provides the generated signals to the all-pass filter 21.

The all-pass filter 21 controls a phase shift amount according to the signals having the sine wave having the frequency of 80 Hz provided from the periodic signal generation unit 13 (Step S25).

If the input speech signals are included in a time range decided by the strained-rough-voice actual time range decision unit 12 in which the input speech signals are to be uttered by a "strained rough voice" (Yes at Step S26), then the switch 22 connects the all-pass filter 21 to the adder 23 (Step S27). Then, the adder 23 adds an output of the all-pass filter 21 to the input speech signals (Step S28). Since the output speech signals of the all-pass filter 21 has a shifted phase, harmonic components with antiphase and the input speech signals which are not converted negate each other. The all-pass filter 21 periodically fluctuates a phase shift amount according to the signals having the sine wave having the frequency of 80 Hz provided from the periodic signal generation unit 13. Therefore, by adding the output of the all-pass filter 21 to the input speech signals, an amount which the signals negate each other is periodically fluctuated at a frequency of 80 Hz. As a result, signals resulting from the addition has an amplitude periodically fluctuated at a frequency of 80 Hz.

On the other hand, if the input speech signals are not included in the time range decided by the strained-rough-voice actual time range decision unit 12 in which the input speech signals are to be uttered by a "strained rough voice" (No at Step S26), then the switch 22 disconnects the all-pass filter 21 from the adder 23, and the strained-rough-voice conversion unit 20 outputs the input speech signals without any processing (Step S29).

With the above structure and method, it is decided, using information of each phoneme and based on an estimation rule, whether or not each phoneme is to be a strained position, and only the phoneme estimated as a strained position is modulated by performing modulation including periodic amplitude fluctuation with a period shorter than a duration of the phoneme, thereby producing a "strained rough" voice at an appropriate position. Thereby, it is possible to generate voices with realistic emotion having texture such as anger, excitement, or nervousness, an animated or lively way of speaking, or the like in which listeners perceive a degree of tension of a phonatory organ, by reproducing a fine time structure. In order to generate periodic amplitude fluctuation with a period shorter than a duration of a phoneme, in other words, in order to increase or decrease energy of speech signals, the second embodiment uses a method of adding (i)

signals generated by periodically fluctuating a phase shift amount by the all-pass filter to (ii) the original waveform. The phase fluctuation generated by the all-pass filter is not uniform to frequency. Thereby, in various frequency components included in the speech, there are components having values to be increased and components having values to be decreased. While in the first embodiment all frequency components have uniform amplitude fluctuation, in the second embodiment more complicated amplitude fluctuation can be achieved thereby providing advantages that damage on naturalness in listening can be prevented and thereby listeners hardly perceive artificial distortion.

It should be noted that it has been described in the second embodiment that at Step S4 the periodic signal generation unit 13 generates signals having a sine wave having a frequency of 80 Hz, but the frequency may be any frequency in a range from 40 Hz to 120 Hz, and the periodic signals may be periodic signals not having a sine wave. This means that a fluctuation frequency of a phase shift amount of the all-pass filter 21 may be any frequency within a range from 40 Hz to 120 Hz, and the all-pass filter 21 may have fluctuation characteristics that are not a sine wave.

It should also be noted that it has been described in the second embodiment that the switch 22 switches between on and off of the connection between the all-pass filter 21 and the adder 23, but the switch 22 may switch between on and off of an input of the all-pass filter 21.

It should also be noted that it has been described in the second embodiment that switching between (i) a portion to be converted as a strained rough voice and (ii) a portion not to be converted is performed by the switch 22 switching connection between the all-pass filter 21 and the adder 23, but the switching may be performed by the adder 23 weighting the output of the all-pass filter 21 and the input speech signals and adding the weighted output to the weighted signals. It is also possible to provide an amplifier between the all-pass filter and the adder 23, and then change a weight between the input speech signals and the output of the all-pass filter 21, in order to switch between (i) a portion to be converted as a strained rough voice and (ii) a portion not to be converted.

(Modification of Second Embodiment)

Figure 15:
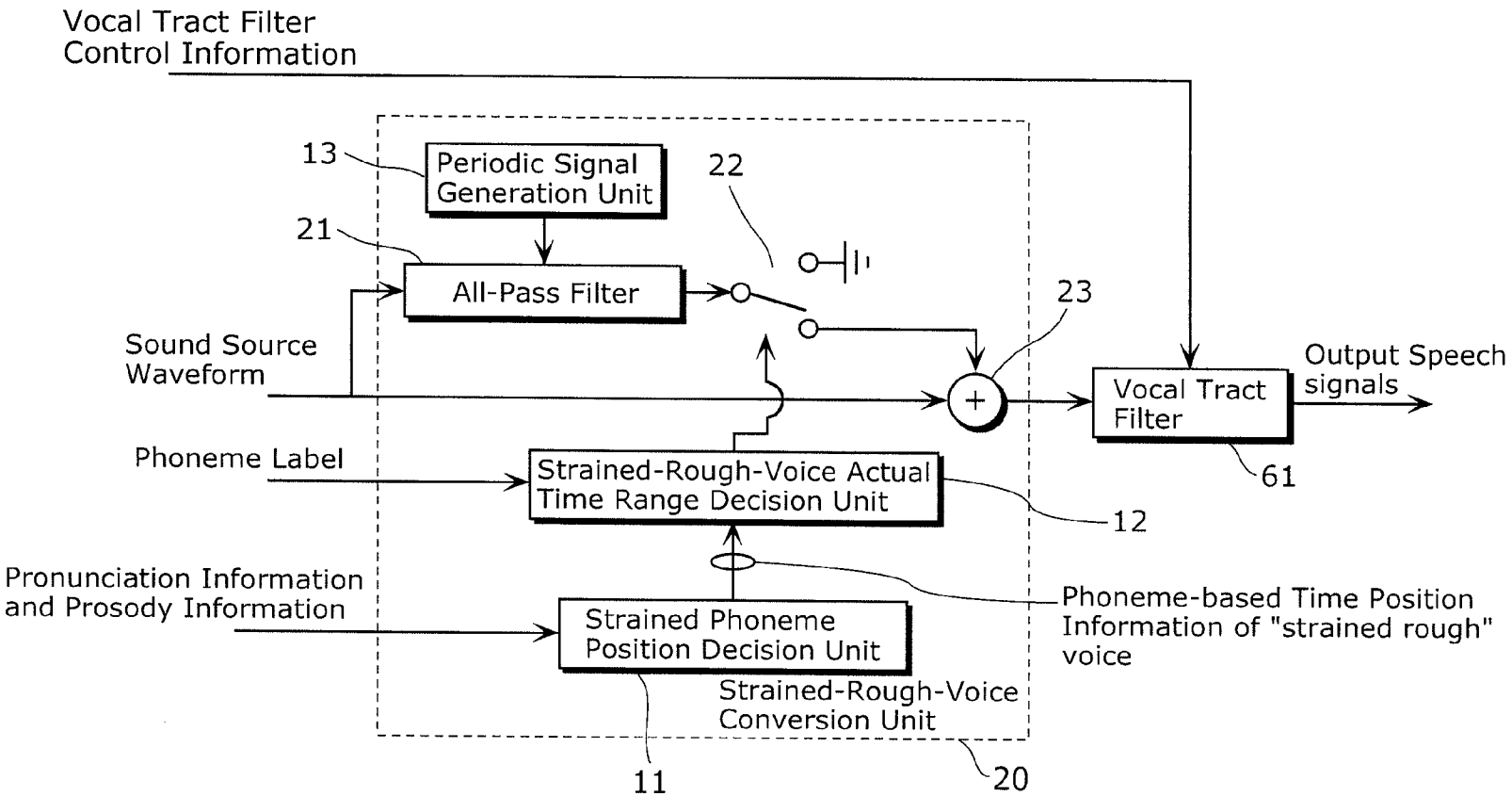
FIG. 15 is a functional block diagram of a modification of the strained-rough-voice conversion unit of the second embodiment of the present invention.
Figure 16:
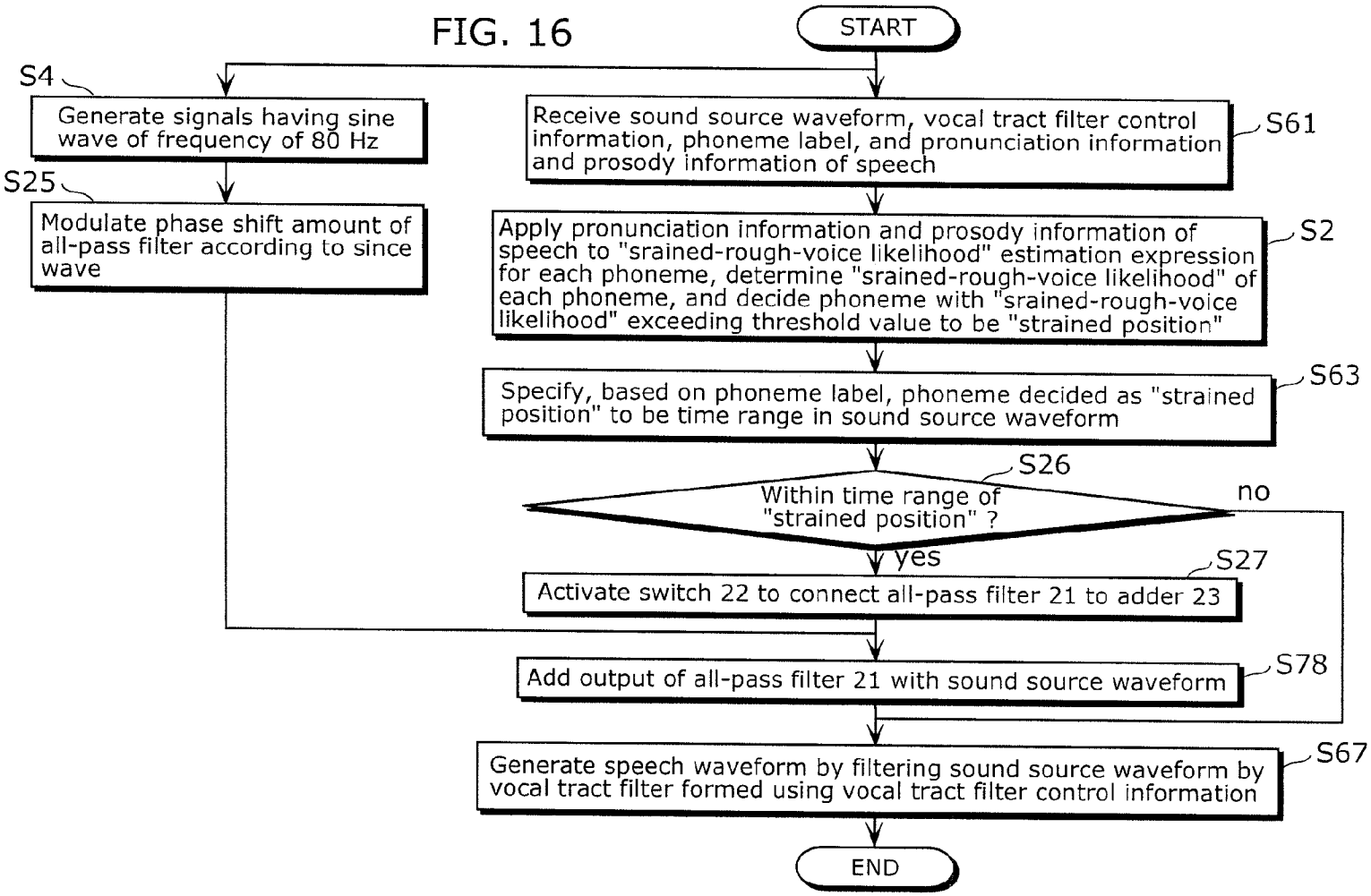
FIG. 16 is a flowchart of processing performed by the modification of the strained-rough-voice conversion unit of the second embodiment of the present invention.

FIG. 15 is a functional block diagram of a modification of the strained-rough-voice conversion unit of the second embodiment, and FIG. 16 is a flowchart of processing performed by the modification of the strained-rough-voice conversion unit of the second embodiment. The same reference numerals and step numerals of FIGS. 13 and 14 are assigned to the identical units of FIGS. 15 and 16, so that the identical units and steps are not explained again below.

As shown in FIG. 15, a structure of the strained-rough-voice conversion unit 20 according to the present modification is similar to the structure of the strained-rough-voice conversion unit 20 of FIG. 13 in the second embodiment, but differs from the second embodiment in receiving a sound source waveform as an input, not speech signals in the second embodiment. For the difference, a voice conversion device or a voice synthesis device according to this modification of the second embodiment further includes a vocal tract filter 61 that filters the received sound source waveform to generate a speech waveform.

Next, processing performed by the strained-rough-voice conversion unit 20 having the above-described structure is described with reference to FIG. 16. Firstly, the strained-rough-voice conversion unit 20 receives a sound source waveform, a phoneme label, and pronunciation information and prosody information of a speech regarding the sound source waveform (Step S61). Here, the phoneme label is provided to the strained-rough-voice actual time range decision unit 12, and the pronunciation information and the prosody information of the speech are provided to the strained phoneme position decision unit 11. Furthermore, the sound source waveform is provided to the adder 23. Next, in the same manner as described in the second embodiment, the strained phoneme position decision unit 11 applies the pronunciation information and the prosody information to a strained-rough-voice likelihood estimation rule to determine a strained-rough-voice likelihood of a phoneme, and if the determined strained-rough-voice likelihood exceeds a predetermined threshold value, decides that the phoneme is to be a strained position (Step S2). The strained-rough-voice actual time range decision unit 12 examines a relationship between (i) the strained position decided by the strained phoneme position decision unit 11 on a phoneme basis and (ii) the phoneme label. Thereby, time position information of a strained rough voice on a phoneme basis is specified as a time range of the strained rough voice in the speech signals (Step S3), and a switch signal is provided from the strained-rough-voice actual time range decision unit 12 to the switch 22. On the other hand, the periodic signal generation unit 13 generates signals having a sine wave having a frequency of 80 Hz (Step S4), and provides the generated signals to the all-pass filter 21. The all-pass filter 21 controls a phase shift amount according to the signals having the sine wave having the frequency of 80 Hz provided from the periodic signal generation unit 13 (Step S25). If the sound source waveform is included in a time range decided by the strained-rough-voice actual time range decision unit 12 in which the sound source waveform is to be uttered by a "strained rough voice" (Yes at Step S26), then the switch 22 connects the all-pass filter 21 to the adder 23 (Step S27). Then, the adder 23 adds an output of the all-pass filter 21 to the input sound source waveform (Step S78), and provides the result to the vocal tract filter 61. On the other hand, if the sound source waveform is not included in the time range decided by the strained-rough-voice actual time range decision unit 12 in which the sound source waveform is to be uttered by a "strained rough voice" (No at Step S26), then the switch 22 disconnects the all-pass filter 21 from the adder 23, and the strained-rough-voice conversion unit 20 outputs the input sound source waveform to the vocal tract filter 61 without any processing. In the same manner as described in the modification of the first embodiment, the vocal tract filter 61 receives, as an input, information for controlling a vocal tract filter corresponding to the sound source waveform received by the strained-rough-voice conversion unit 20, and forms a vocal tract filter corresponding to the sound source waveform provided from the amplitude modulation unit 14. The sound source waveform provided from the amplitude modulation unit 14 passes through the vocal tract filter 61 to be generated as a speech waveform (Step S67).

As described in the second embodiment, with the above structure, by generating a "strained rough" voice at an appropriate position, it is possible to generate voices with realistic emotion having texture such as anger, excitement, or nervousness, an animated or lively way of speaking or the like in which listeners perceive a degree of tension of a phonatory organ, by reproducing a fine time structure. In addition, amplitude is modulated using a phase change of the all-pass filter in order to produce more complicated amplitude fluctuation, so that naturalness in listening is not damaged and thereby listeners hardly perceive artificial distortion. In addition, as described in the modification of the first embodiment, by modulating a sound source waveform not a vocal tract filter mainly related to a shape of a mouth or lips, it is possible to generate a natural "strained rough" voice which is similar to phenomenon of actual utterances and in which listeners hardly perceive artificial distortion.

It should be noted that is has been described in the modification of the second embodiment that at Step S4 the periodic signal generation unit 13 generates signals having a sine wave having a frequency of 80 Hz and the phase shift amount of the all-pass filter 21 depends on the sine wave, but the frequency may be any frequency in a range from 40 Hz to 120 Hz, and the all-pass filter 21 may have fluctuation characteristics that are not a sine wave.

It should also be noted that it has been described in the modification of the second embodiment that the switch 22 switches between on and off of the connection between the all-pass filter 21 and the adder 23, but the switch 22 may switch between on and off of an input of the all-pass filter 21.

It should also be noted that it has been described in the modification of the second embodiment that switching between (i) a portion to be converted as a strained rough voice and (ii) a portion not to be converted is performed by the switch 22 switching connection between the all-pass filter 21 and the adder 23, but the switching may be performed by the adder 23 weighting the output of the all-pass filter 21 and the input sound source waveform and adding the weighted output to the weighted signals. It is also possible to provide an amplifier between the all-pass filter and the adder 23 and then change a weight between the input sound source waveform and the output of the all-pass filter 21, in order to switch between (i) a portion to be converted as a strained rough voice and (ii) a portion not to be converted.

(Third Embodiment)

Figure 17:
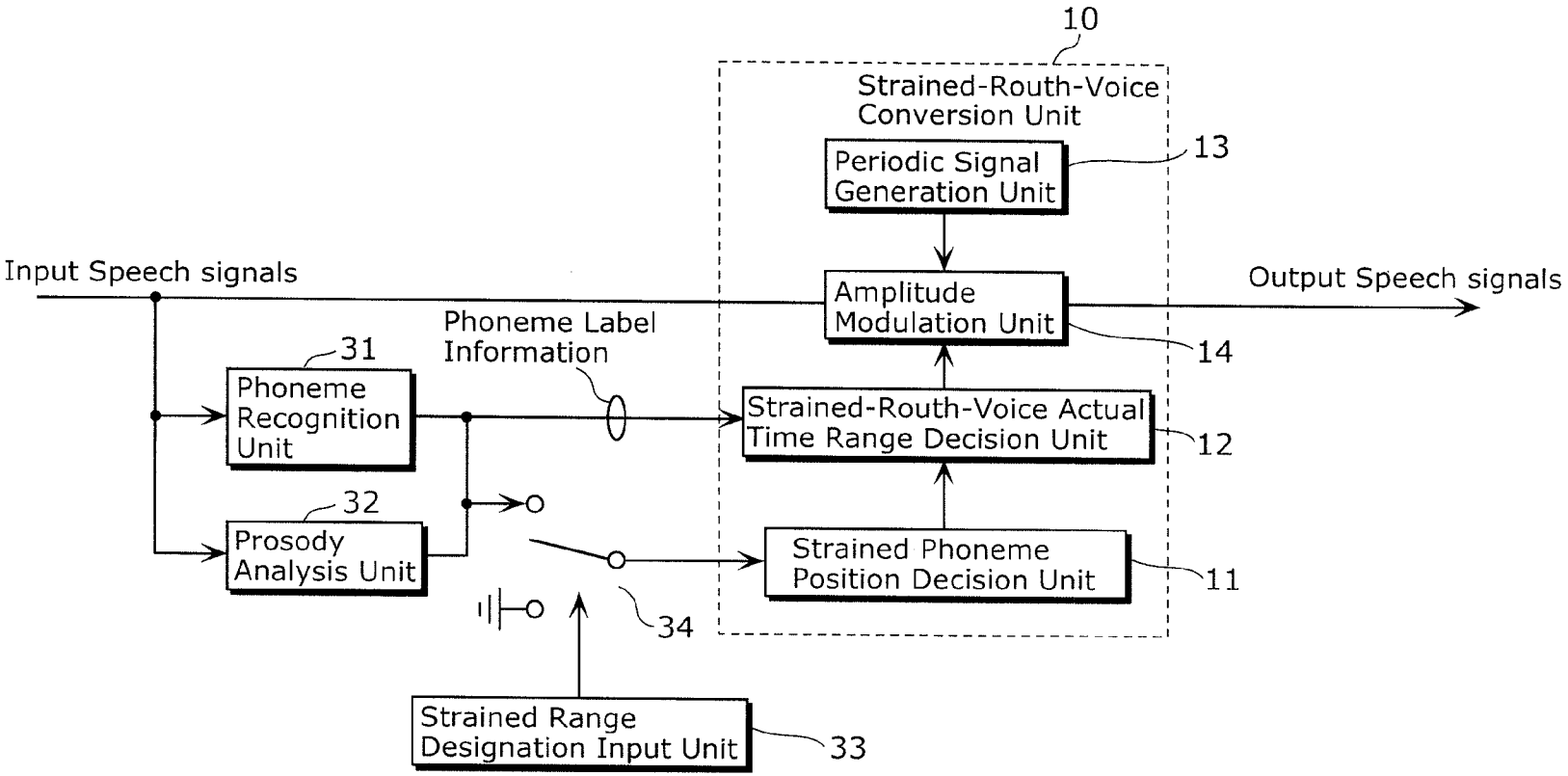
FIG. 17 is a block diagram showing a structure of a voice conversion device according to a third embodiment of the present invention.
Figure 18:
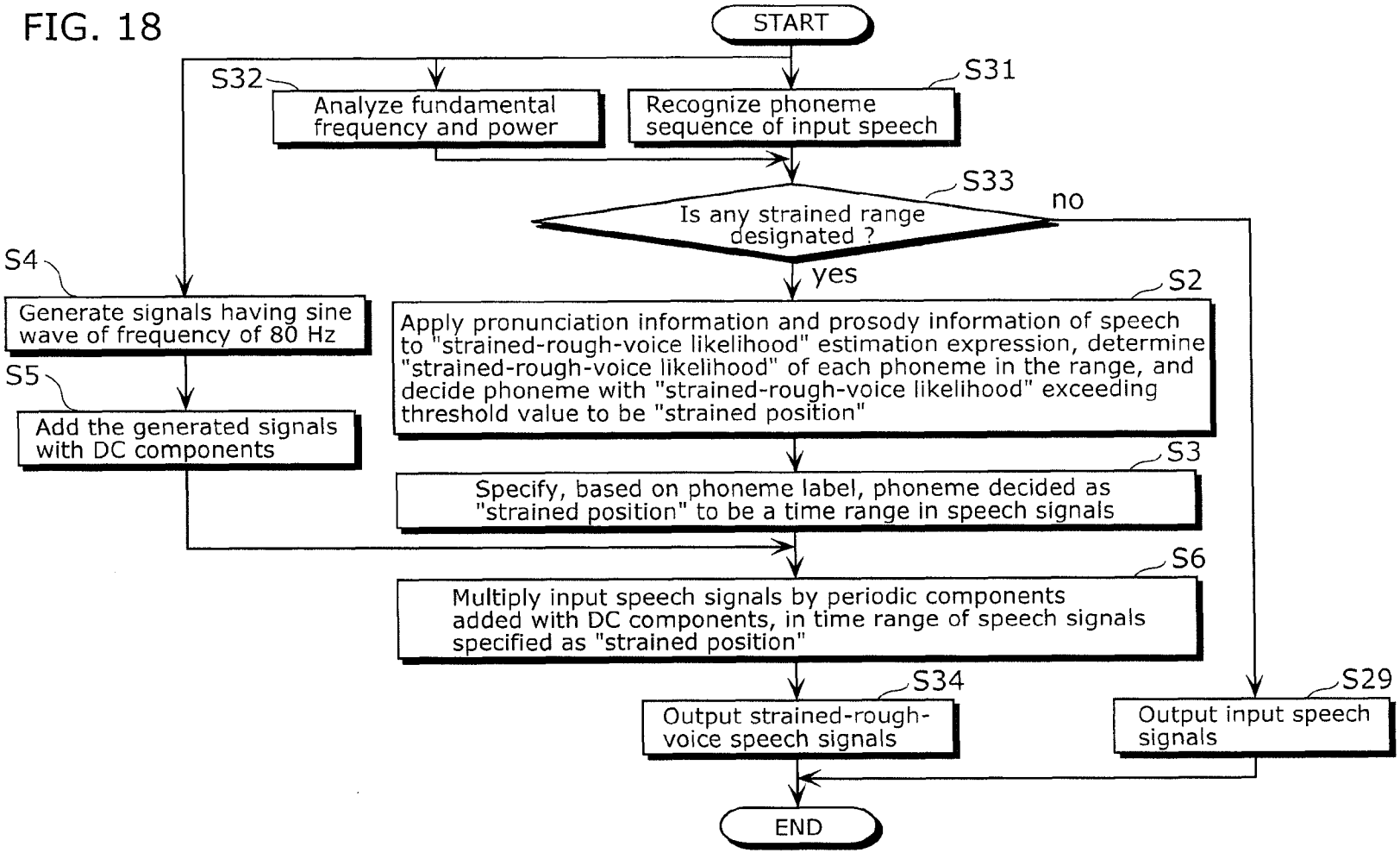
FIG. 18 is a flowchart of processing performed by the voice conversion device according to the third embodiment of the present invention.

FIG. 17 is a block diagram showing a structure of a voice conversion device according to a third embodiment of the present invention. FIG. 18 is a flowchart of processing performed by the voice conversion device according to the third embodiment. The same reference numerals and step numerals of FIGS. 1 and 10 are assigned to the identical units of FIGS. 17 and 18, so that the identical units and steps are not explained again below.

As shown in FIG. 17, the voice conversion device according to the present invention is a device that converts input speech signals to speech signals uttered by strained rough voices. The voice conversion device includes a phoneme recognition unit 31, a prosody analysis unit 32, a strained range designation input unit 33, a switch 34, and a strained-rough-voice conversion unit 10.

The strained-rough-voice conversion unit 10 is the same as the strained-rough-voice conversion unit 10 of the first embodiment, so that details of the strained-rough-voice conversion unit 10 are not explained again below.

The phoneme recognition unit 31 is a processing unit that receives input speech (voices), matches the input speech to an acoustic model, and generates a sequence of phonemes (hereinafter, referred to as a "phoneme sequence").

The prosody analysis unit 32 is a processing unit that receives the input speech (voices) and analyzes a fundamental frequency and power of the input speech.

The strained range designation input unit 33 is a processing unit that designates, in the input speech, a range of a voice which a user desires to convert to a strained rough voice. For example, the strained range designation input unit 33 is a "strained rough voice switch" provided in a microphone or a loudspeaker, and a voice inputted while the user is pressing the strained rough voice switch is designated as a "strained range". For another example, the strained range designation input unit 33 is an input device or the like for designating a "strained range" when a user monitors an input speech and presses a "strained rough voice switch" while a voice to be converted to a strained rough voice is inputted.

The switch 34 is a switch that switches (selects) whether or not an output of the phoneme recognition unit 31 and an output of the prosody analysis unit 32 are provided to the strained phoneme position decision unit 11.

Next, processing performed by the voice conversion device having the above-described structure is described with reference to FIG. 18.

Firstly, the voice conversion device receives a speech (voices). Here, the input speech is provided to both of the phoneme recognition unit 31 and the prosody analysis unit 32. The phoneme recognition unit 31 analyzes spectrum of signals of the input speech (input speech signals), matches the resulting spectrum information of the input speech to an acoustic model, and determines phonemes in the input speech (Step S31).

On the other hand, the prosody analysis unit 32 analyzes a fundamental frequency and power of the input speech (Step S32).

The switch 34 detects whether or not any strained range is designated by the strained range designation input unit 33 (Step S33).

If any strained range is designated (Yes at Step S33), the strained phoneme position decision unit 11 applies pronunciation information and prosody information to a strained-rough-voice likelihood estimation rule to determine a strained-rough-voice likelihood of each phoneme in the designated strained range. If the strained-rough-voice likelihood exceeds a predetermined threshold value, the strained phoneme position decision unit 11 decides the phoneme as a strained position (Step S2). While in the first embodiment the prosody information in independent variables in Quantification Method II has been described as a distance from an accent nucleus or a position in an accent phase, in the third embodiment the prosody information is assumed to be a value analyzed by the prosody analysis unit 32, such as an absolute value of a fundamental frequency, tilt of a fundamental frequency in a time axis, tilt of power in a time axis, or the like.

The strained-rough-voice actual time range decision unit 12 examines a relationship between (i) the strained position decided by the strained phoneme position decision unit 11 on a phoneme basis and (ii) the phoneme label. Thereby, time position information of a strained rough voice on a phoneme basis is specified as a time range of the strained rough voice in the speech signals (Step S31).

On the other hand, the periodic signal generation unit 13 generates signals having a sine wave having a frequency of 80 Hz (Step S4), and then adds the generated signals with DC components to generate signals (Step S5).

For an actual time range specified in the speech signals as a "strained position", the amplitude modulation unit 14 performs amplitude modulation by multiplying the input speech signals by periodic signals generated by the periodic signal generation unit 13 to vibrate with a frequency of 80 Hz (Step S6), converts a voice at the actual time range to a "strained rough" voice including periodic amplitude fluctuation with a period shorter than a duration of a phoneme of the voice, and outputs the strained rough voice (Step S34).

If no strained range is designated (No at Step S33), then the amplitude modulation unit 14 outputs the input speech signals without being converted (Step S29).

With the above structure and method, in a designation region designated by a user in an input speech, it is decided, using information of each phoneme and based on an estimation rule, whether or not each phoneme is to be a strained position, and only the phoneme estimated as a strained position is modulated by performing modulation including periodic amplitude fluctuation with a period shorter than a duration of the phoneme, thereby producing a "strained rough" voice at an appropriate position. Thereby, without providing unnaturalness of noise superimposition and impression of sound quality deterioration which occur when an input speech is uniformly transformed, it is possible to convert an input speech to a speech having richer expression with voice quality having reality, such as anger, excitement, or nervousness, animated or lively impression, or the like in which listeners perceive a degree of tension of a phonatory organ, by reproducing a fine time structure. This means that, information required to estimate a strained position can be extracted even if an input is sound (speech) only, which makes it possible to the input sound (speech) to a speech with rich expression uttering a "strained rough" voice at an appropriate position.

It should be noted that it has been described in the third embodiment that the switch 34 is controlled by the strained range designation input unit 33 to switch (select) the phoneme recognition unit 31 or the prosody analysis unit 32 to be connected to the strained phoneme position decision unit 11 that decides a position of a phoneme as a strained rough voice from among only voices in a range designated by the user. However, the switch 34 may be replaced as input parts of the phoneme recognition unit 31 and the prosody analysis unit 32 to switch between On or Off of input of speech signals to the phoneme recognition unit 31 and the prosody analysis unit 32.

It should also be noted that it has been described in the third embodiment that the strained-rough-voice conversion unit 10 performs conversion to a strained rough voice, but the conversion may be performed using the strained-rough-voice conversion unit 20 described in the second embodiment.

(Modification of Third Embodiment)

Figure 19:
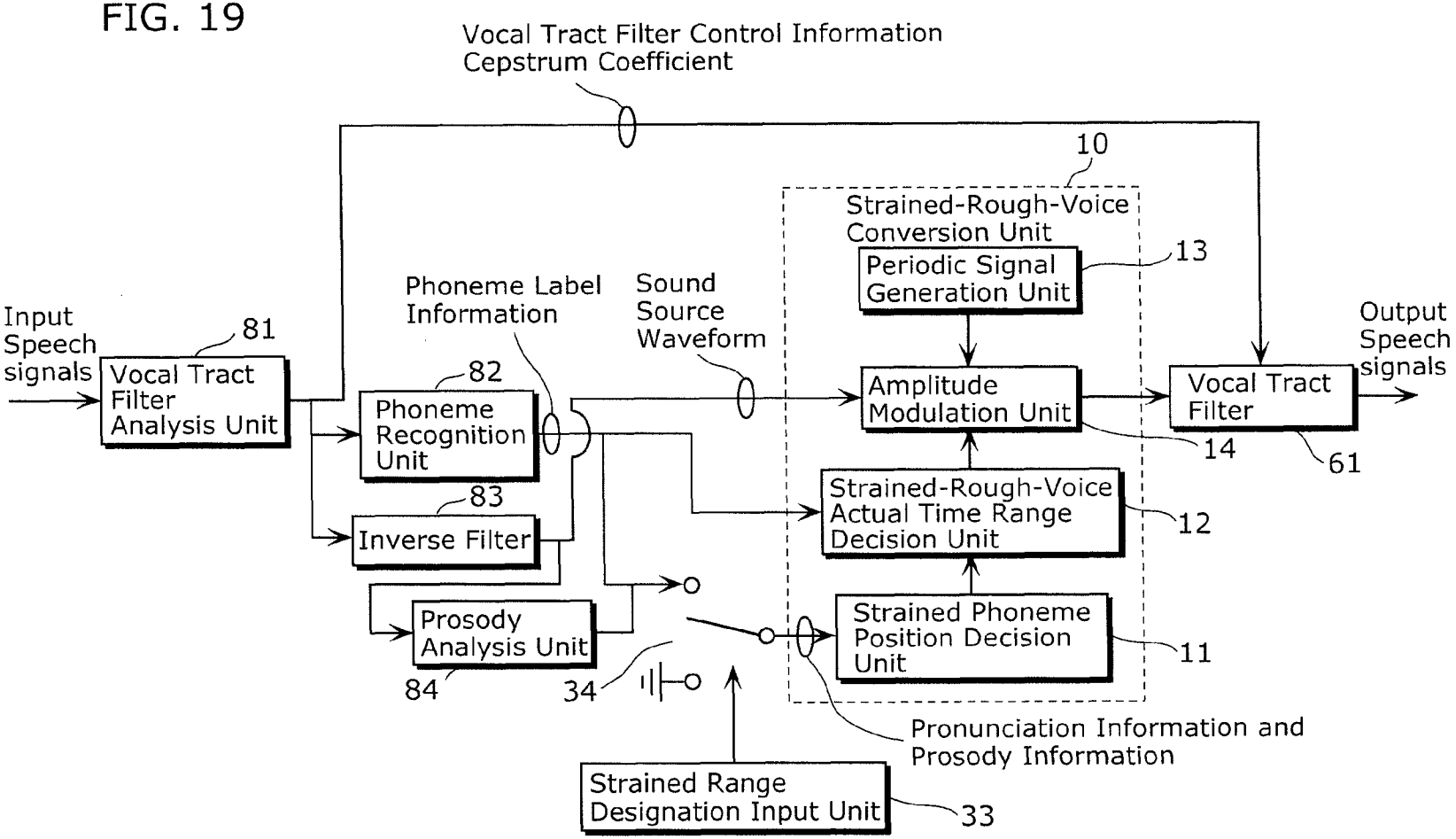
FIG. 19 is a functional block diagram of a modification of the voice conversion device of the third embodiment of the present invention.
Figure 20:
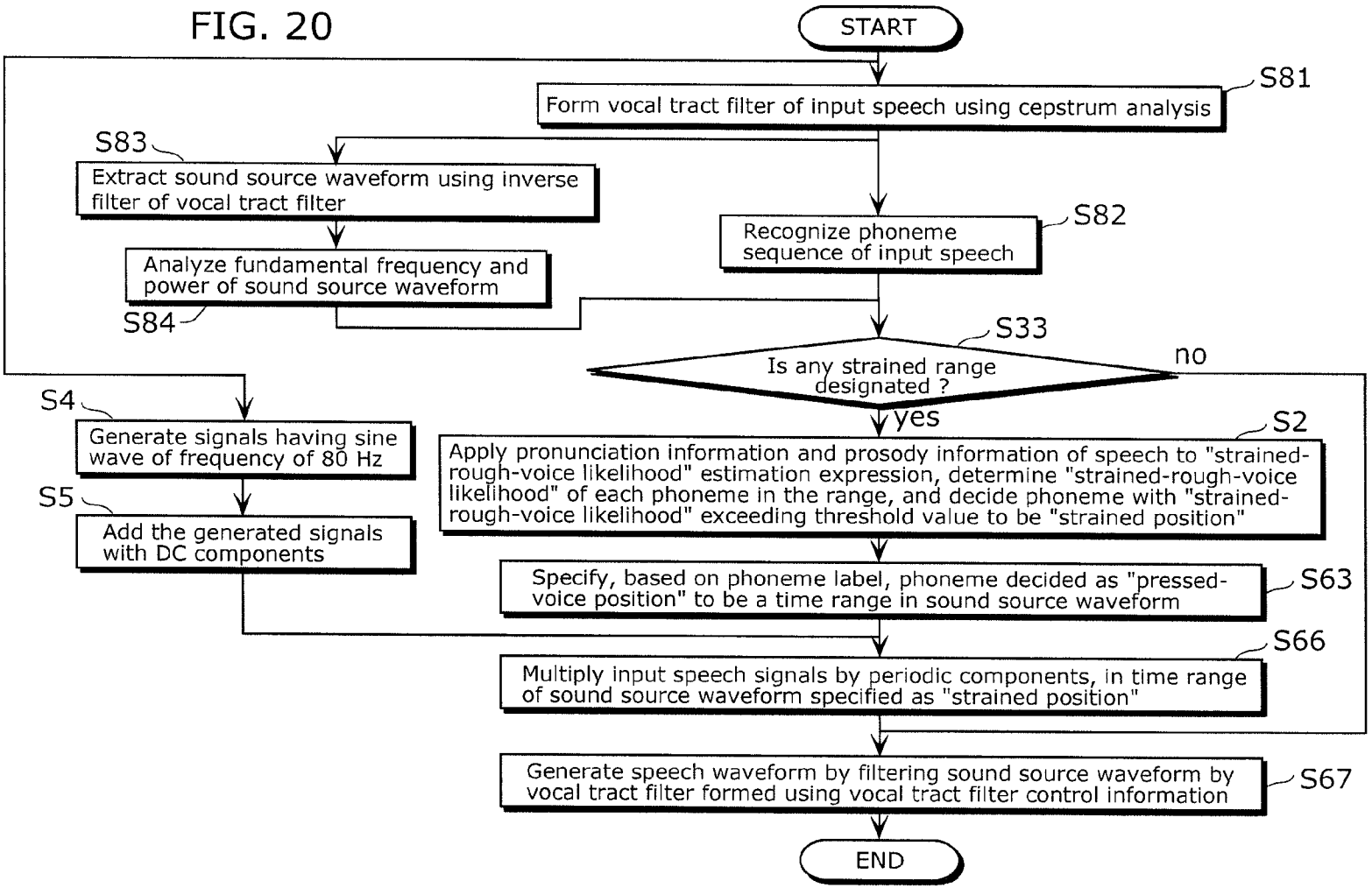
FIG. 20 is a flowchart of processing performed by the modification of the voice conversion device of the third embodiment of the present invention.

FIG. 19 is a functional block diagram of a modification of the voice conversion device of the third embodiment, and FIG. 20 is a flowchart of processing performed by the modification of the voice conversion device of the third embodiment. The same reference numerals and step numerals of FIGS. 17 and 18 are assigned to the identical units of FIGS. 19 and 20, so that the identical units and steps are not explained again below.

As shown in FIG. 19, the voice conversion device according to the modification of the third embodiment includes, the strained range designation input unit 33, the switch 34, and the strained-rough-voice conversion unit 10 which are the same as those in FIG. 17 of the third embodiment. The voice conversion device according to the modification further includes: a vocal tract filter analysis unit 81 that receives an input speech and analyzes cepstrum of the input speech; a phoneme recognition unit 82 that recognizes phonemes in the input speech based on cepstrum coefficients generated and provided by the vocal tract filter analysis unit; an inverse filter 83 that is formed based on the cepstrum coefficients provided from the vocal tract filter analysis unit; a prosody analysis unit 84 that analyzes prosody from a sound source waveform extracted by the inverse filter 83; and a vocal tract filter 61.

Next, processing performed by the voice conversion device having the above-described structure is described with reference to FIG. 20. Firstly, the voice conversion device receives a speech (voices). Here, the input speech is provided to the vocal tract filter analysis unit 81. The vocal tract filter analysis unit 81 analyzes cepstrum of speech signals of the input speech to determine a cepstrum coefficient sequence for forming a vocal tract filter of the input speech (Step S81). The phoneme recognition unit 82 matches the cepstrum coefficients provided from the vocal tract filter analysis unit 81 to an acoustic model so as to determine phonemes in the input speech (Step S82). On the other hand, the inverse filter 83 forms an inverse filter using the cepstrum coefficients provided from the vocal tract filter analysis unit 81 in order to generate a sound source waveform of the input speech (Step S83). The prosody analysis unit 84 analyzes a fundamental frequency of the sound source waveform provided from the inverse filter 83 and determines power (Step S84). The strained phoneme position decision unit 11 determines whether or not any strained range is designated by the strained range designation input unit 33 (Step S33). If any strained range is designated (Yes at Step S33), the strained phoneme position decision unit 11 applies pronunciation information and prosody information to a strained-rough-voice likelihood estimation rule to determine a strained-rough-voice likelihood of each phoneme in the designated strained range. If the strained-rough-voice likelihood exceeds a predetermined threshold value, the strained phoneme position decision unit 11 decides the phoneme as a strained position (Step 52). The strained-rough-voice actual time range decision unit 12 examines a relationship between (i) a strained position decided for each phoneme by the strained phoneme position decision unit 11 and (ii) the phoneme label, and thereby specifies a time position information of a strained rough voice for each phoneme as a time range in the sound source waveform (Step S63). On the other hand, the periodic signal generation unit 13 generates signals having a sine wave having a frequency of 80 Hz (Step S4), and then adds the generated signals with DC components to generate signals (Step S5). For the actual time range which is in the sound source waveform and specified as a "strained position", the amplitude modulation unit 14 performs amplitude modulation by multiplying the sound source waveform by periodic signals generated by the periodic signal generation unit 13 to vibrate with a frequency of 80 Hz (Step S66). The vocal tract filter 61 forms a vocal tract filter based on the cepstrum coefficient sequence (namely, information for controlling the vocal tract filter) provided from the vocal tract filter analysis unit 81. The sound source waveform provided from the amplitude modulation unit 14 passes through the vocal tract filter 61 to be generated as a speech waveform (Step S67).

With the above structure and method, in a designation region designated by a user in an input speech, it is decided, using information of each phoneme and based on an estimation rule, whether or not each phoneme is to be a strained position, and only the phoneme estimated as a strained position is modulated by performing modulation including periodic amplitude fluctuation with a period shorter than a duration of the phoneme, thereby producing a "strained rough" voice at an appropriate position. Thereby, without providing unnaturalness of noise superimposition and impression of sound quality deterioration which occur when an input speech is uniformly transformed, it is possible to convert an input speech to a speech having richer expression with voice quality having reality such as anger, excitement, or nervousness, animated or lively impression, or the like in which listeners perceive a degree of tension of a phonatory organ, by reproducing a fine time structure. This means that, information required to estimate a strained position can be extracted even if an input is sound (speech) only, which makes it possible to the input sound (speech) to a speech with rich expression uttering a "strained rough" voice at an appropriate position. In addition, as described in the modification of the first embodiment, by modulating a sound source waveform not a vocal tract filter mainly related to a shape of a mouth or lips, it is possible to generate a natural "strained rough" voice which is similar to phenomenon of actual utterances and in which listeners hardly perceive artificial distortion.

It should be noted that it has been described in the modification of the third embodiment that the switch 34 is controlled by the strained range designation input unit 33 to switch (select) the phoneme recognition unit 82 or the prosody analysis unit 84 to be connected to the strained phoneme position decision unit 11 that decides a position of a phoneme as a strained rough voice from among only voices in a range designated by the user, but the switch 34 may be provided at a stage prior to the phoneme recognition unit 82 and the prosody analysis unit 84 to select whether speech signals are provided to the phoneme recognition unit 82 or the prosody analysis unit 84.

It should also be noted that it has been described in the modification of the third embodiment that the strained-rough-voice conversion unit 10 performs conversion to a strained rough voice, but the conversion may be performed using the strained-rough-voice conversion unit 20 described in the second embodiment.

(Fourth Embodiment)

Figure 21:
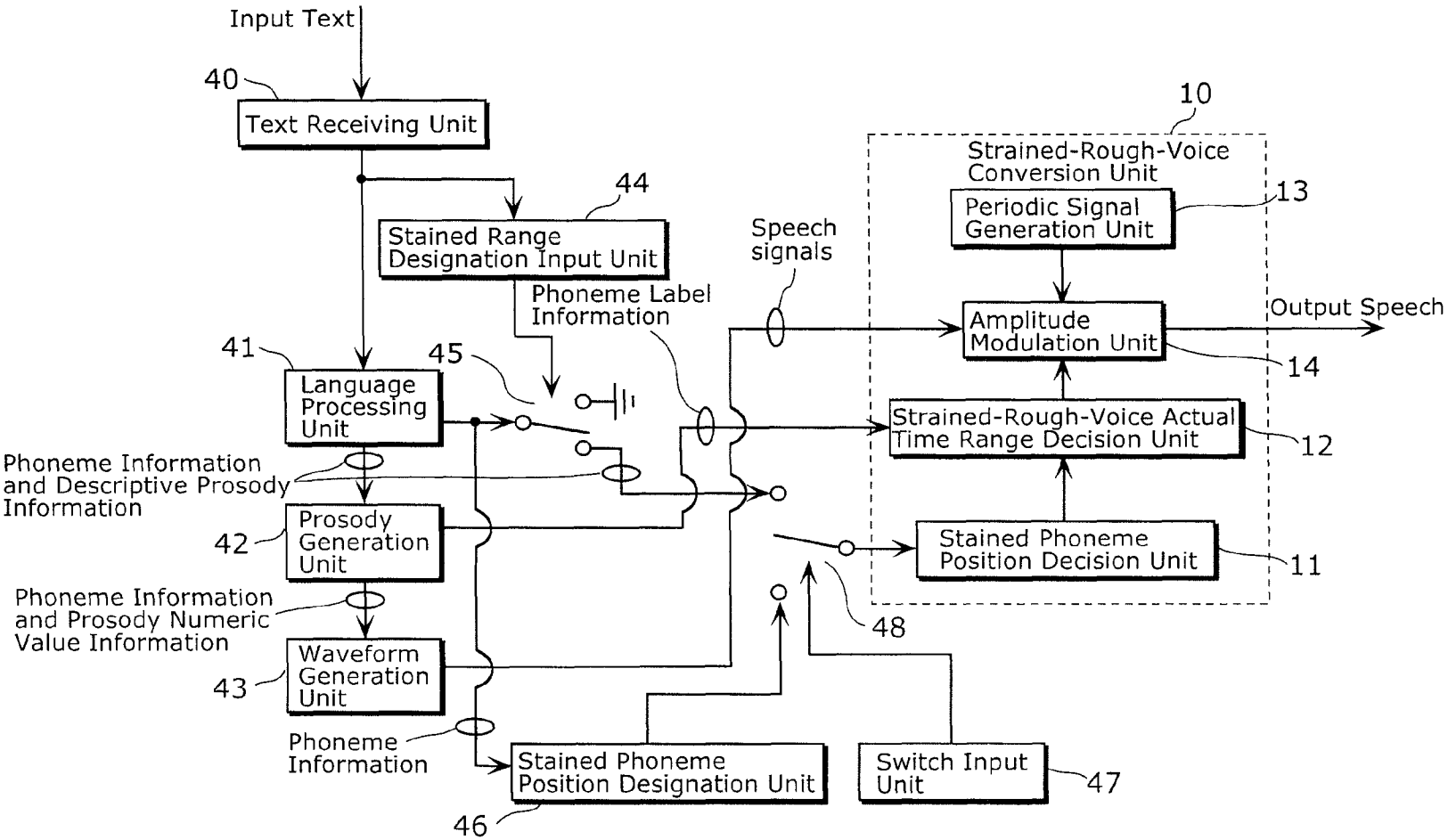
FIG. 21 is a block diagram showing a structure of a voice synthesis device according to a fourth embodiment of the present invention.
Figure 22:
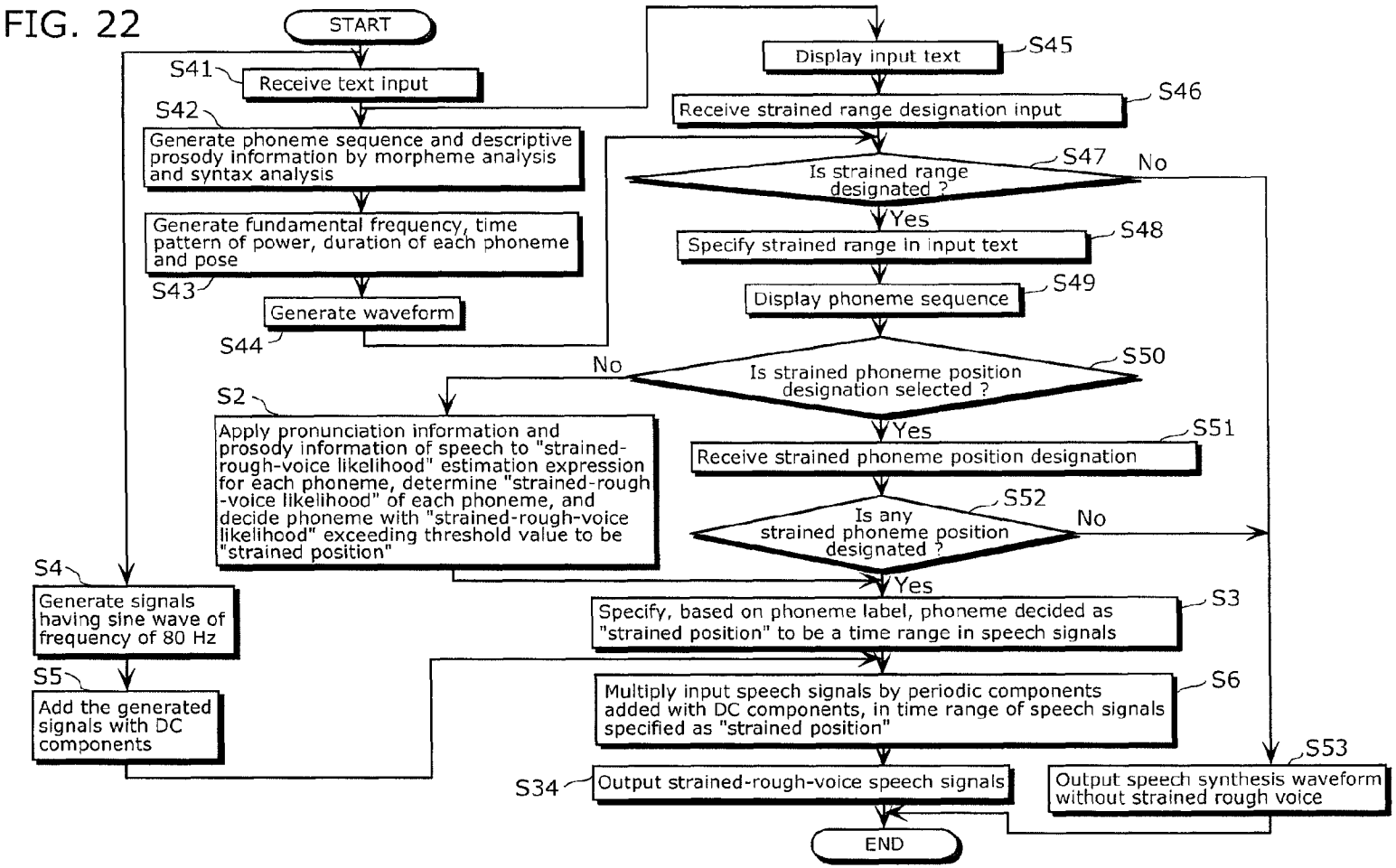
FIG. 22 is a flowchart of processing performed by the voice synthesis device according to the fourth embodiment of the present invention.
Figure 23:
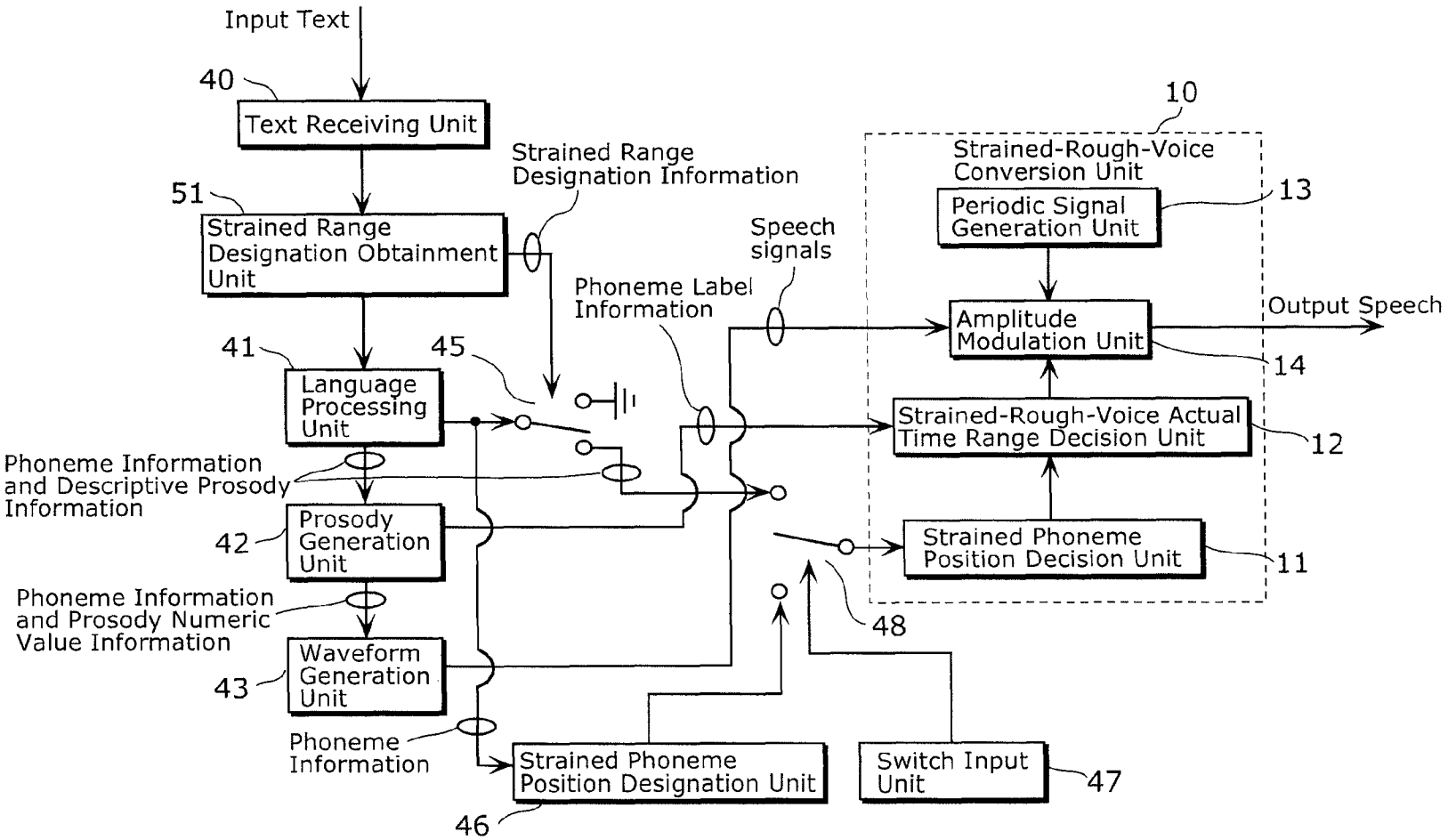
FIG. 23 is a block diagram showing a structure of a voice synthesis device according to a modification of the fourth embodiment of the present invention.

FIG. 21 is a block diagram showing a structure of a voice synthesis device according to a fourth embodiment. FIG. 22 is a flowchart of processing performed by the voice synthesis device according to the fourth embodiment. FIG. 23 is a block diagram showing a structure of a voice synthesis device according to the fourth embodiment. Each of FIGS. 24 and 25 show an example of an input provided to the voice synthesis device according to the modification. The same reference numerals and step numerals of FIGS. 1 and 10 are assigned to the identical units of FIGS. 21 and 22, so that the identical units and steps are not explained again below.

As shown in FIG. 21, the voice synthesis device according to the fourth embodiment is a device that synthesizes a speech (voices) produced by reading out an input text. The voice synthesis device includes a text receiving unit 40, a language processing unit 41, a prosody generation unit 42, a waveform generation unit 43, a strained range designation input unit 44, a strained phoneme position designation unit 46, a switch input unit 47, a switch 45, a switch 48, and a strained-rough-voice conversion unit 10.

The strained-rough-voice conversion unit 10 is the same as the strained-rough-voice conversion unit 10 of the first embodiment, so that details of the strained-rough-voice conversion unit 10 are not explained again below.

The text receiving unit 40 is a processing unit that receives a text inputted by a user or by other methods and provides the received text both to the language processing unit 41 and the strained range designation input unit 44.

The language processing unit 41 is a processing unit that, when the input text is provided, (i) performs morpheme analysis on the input text to divide the text into words and then specify pronunciation of the words, and (ii) also performs syntax analysis to determine dependency relationships among the words to transform the pronunciation of the words thereby generating descriptive prosody information such as accent phrases or phrases.

The prosody generation unit 42 is a processing unit that generates a duration of each phoneme and pose, a fundamental frequency, and a value of amplitude or power, using the pronunciation information and the descriptive prosody information provided from the language processing unit 41.

The waveform generation unit 43 is a processing unit that receives (i) the pronunciation information from the language processing unit 41 and (ii) the duration of each phoneme and pose, the fundamental frequency, and the value of amplitude or power from the prosody generation unit 42, and then generates a speech waveform as designated. If the waveform generation unit 43 employs a speech synthesis method using waveform concatenation, the waveform generation unit 43 includes a snippet selection unit and a snippet database. On the other hand, if the waveform generation unit 43 employs a speech synthesis method using rule synthesis, the waveform generation unit 43 includes a generation model and a signal generation unit depending on an employed generation model.

The strained range designation input unit 44 is a processing unit that designates a range which is in the text and which a user desires to be uttered by a strained rough voice. For example, the strained range designation input unit 44 is an input device or the like, by which a text inputted by the user is displayed on a display, and when the user points a portion of the displayed text, the pointed portion is inverted and designated as a "strained range" in the text.

The strained phoneme position designation unit 46 is a processing unit that designates, for each phoneme, a range which the user desires to be uttered by a strained rough voice. For example, the strained phoneme position designation unit 46 is an input device or the like, by which a phonologic sequence generated by the language processing unit 41 is displayed on a display, and when the user points a portion of the displayed phonologic sequence, the pointed portion is inverted and designated as a "strained range" for each phoneme.

The switch input unit 47 is a processing unit that receives switch designation to select (i) a method by which a strained phoneme position is set by the user or (ii) a method by which the strained phoneme position is set automatically, and controls the switch 48 according to the switch designation.

The switch 45 is a switch that switches between on and off of connection between the language processing unit 41 and the strained phoneme position decision unit 11. The switch 48 is a switch that switches (selects) an output of the language processing unit 41 or an output of the strained phoneme position designation unit 46 designated by the user, in order to be provided to the strained phoneme position decision unit 11.

Next, processing performed by the voice conversion device having the above-described structure is described with reference to FIG. 22.

Firstly, the text receiving unit 40 receives an input text (Step S41). The text input is, for example, an input using a keyboard, an input of an already-recorded text data, reading by character recognition, or the like. The text receiving unit 40 provides the received text both to the language processing unit 41 and the strained range designation input unit 44.

The language processing unit 41 generates a phonologic sequence and descriptive prosody information using morpheme analysis and syntax analysis (Step S42). In the morpheme analysis and the syntax analysis, by matching the input text a model using a language model and a dictionary, such as Ngram, the input text is divided to words appropriately and dependency of each word is analyzed. In addition, based on pronunciation of words and dependency among the words, the language processing unit 41 generates descriptive prosody information such as accents, accent phrases, and phrases.

The prosody generation unit 42 receives the phoneme information and the descriptive prosody information from the language processing unit 41, and based on the phonologic sequence and the descriptive prosody information, decides a duration of each phoneme and pose, a fundamental frequency, and a value of power or amplitude (Step S43). The numeric value information of prosody (prosody numeric value information) is generated, for example, based on a prosody generation model generated by statistical learning or a prosody generation model derived from an utterance mechanism.

The waveform generation unit 43 receives the phoneme information from the language processing unit 41 and the prosody numeric value information from the prosody generation unit 42, and generates a speech waveform corresponding to those information. (Step S44). Examples of a method of generating a waveform are: a method using waveform concatenation by which optimum speech snippets are selected and concatenated to each other based on a phonologic sequence and prosody information; a method of generating a speech waveform by generating sound source signals based on prosody information and passing the generated sound source signals through a vocal tract filter formed based on a phonologic sequence; a method of generating a speech waveform by estimating a spectrum parameter using a phonologic sequence and prosody information; and the like.

On the other hand, the strained range designation input unit 44 receives a text inputted at Step S41 and provides the received text (input text) to a user (Step S45). In addition, the strained range designation input unit 44 receives a strained range which the user designates on the text (Step S46).

If the strained range designation input unit 44 does not receive any designation of a portion or all of the input text (No at Step S47), then the strained range designation input unit 44 turns the switch 45 OFF, and thereby the voice synthesis device according to the fourth embodiment outputs the synthetic speech (waveform) generated at Step S44 (Step S53).

On the other hand, if the strained range designation input unit 44 receives designation of a portion or all of the input text (Yes at Step S47), then the strained range designation input unit 44 specifies a strained range in the input text and turns the switch 45 ON to be connected to the switch 48 to provide the switch 48 with the phoneme information and the descriptive prosody information generated by the language processing unit 41 and the strained range information. Moreover, the phonologic sequence outputted from the language processing unit 41 is provided to the strained phoneme position designation unit 46 and presented to the user (Step S49).

When the user desires to select to perform fine designation on a strained phoneme position basis (referred to also as "strained phoneme position designation) rather than rough designation on a strained range basis, switch designation is provided to the switch input unit 47 to allow the strained phoneme position to be designated manually.

If the designation is selected to be performed on a strained phoneme position basis (Yes at Step S50), then the switch input unit 47 connects the switch 48 to the strained phoneme position designation unit 46. The strained phoneme position designation unit 46 receives strained phoneme position designation information from the user (Step S51). The user designates a strained phoneme position, by, for example, designating a phoneme to be uttered by a strained rough voice in a phonologic sequence presented on a display.

If no strained phoneme position is designated (No at Step S52), then the strained phoneme position decision unit 11 does not designate any phoneme as a strained phoneme position, and thereby the voice synthesis device according to the fourth embodiment outputs the synthetic speech (waveform) generated at Step S44 (Step S53).

On the other hand, if any strained phoneme position is designated (Yes at Step S52), then the strained phoneme position decision unit 11 decides the designated phoneme position provided from the strained phoneme position designation unit 46 at Step S51 as a strained phoneme position.

On the other hand, if the designation is selected not to be performed on a strained phoneme position basis (No at Step S50), then the strained phoneme position decision unit 11 applies, in the same manner as described in the first embodiment, the pronunciation information and the prosody information of each phoneme in a strained range specified at Step S48 to the "strained-rough-voice likelihood" estimation expression in order to determine a "strained-rough-voice likelihood" of the phoneme. In addition, the strained phoneme position decision unit 11 decides, as a "strained position", a phoneme having the determined "strained-rough-voice likelihood" that exceeds a predetermined threshold value (Step S2). Although in the first embodiment that the Quantification Method II has been described to be used, in the fourth embodiment two-class classification of whether a voice is strained or not strained is predicted using a Support Vector Machine (SVM) that receives phoneme information and prosody information. Like other statistical techniques, in the SVM, regarding learning speech data including a "strained rough" voice, a target phoneme, a phoneme immediately prior to the target phoneme, a phoneme immediately subsequent to the target phoneme, a position in an accent phrase, a relative position to accent nucleus, and positions in a phrase and a sentence are received for each target phoneme, and then a model for estimating whether or not each phoneme (target phoneme) is a strained rough voice is learned. From the phoneme information and the descriptive prosody information provided from the language processing unit 41, the strained phoneme position decision unit 11 extracts input variables of the SVM that are a target phoneme, a phoneme immediately prior to the target phoneme, a phoneme immediately subsequent to the target phoneme, a position in an accent phrase, a relative position to accent nucleus, and positions in a phrase and a sentence are received for each target phoneme, and decides whether or not each phoneme (target phoneme) is to be uttered by a strained rough voice.

Based on duration information (namely, phoneme label) of each phoneme provided from the prosody generation unit 42, the strained-rough-voice actual time range decision unit 12 specifies time position information of a phoneme decided to be a "strained position", as a time range in the synthetic speech waveform generated by the waveform generation unit 43 (Step S3).

In the same manner as described in the first embodiment, the periodic signal generation unit 13 generates signals having a sine wave having a frequency of 80 Hz (Step S4), and then adds the generated signals with DC components to generate signals (Step S5).

For the time rage of the speech signals specified as the "strained position", the amplitude modulation unit 14 multiplies (i) the synthetic speech signals by (ii) periodic components added with the DC components (Step S6). The voice synthesis device according to the fourth embodiment outputs a synthesis speech including the strained rough voice (Step S34).

With the above structure, in a designation region designated by a user in an input text, it is decided, using information of each phoneme and based on an estimation rule information of each phoneme, whether or not each phoneme is to be a strained position, and only the phoneme estimated as a strained position is modulated by performing modulation including periodic amplitude fluctuation with a period shorter than a duration of the phoneme, thereby producing a "strained rough" voice at an appropriate position. Or, a phoneme designated by a user in a phonologic sequence used in converting an input text to speech is modulated by performing modulation including periodic amplitude fluctuation with a period shorter than a duration of the phoneme, thereby producing a "strained rough" voice. Thereby, it is possible to prevent unnaturalness of noise superimposition and impression of sound quality deterioration which occur when an input speech is uniformly transformed. In addition, the user designs vocal expression as he/she desires, and thereby reproducing, as a fine time structure, impression of anger, excitement, or nervousness, or animated or lively impression in which listeners perceive a degree of tension of a phonatory organ, and adding the fine time structure as texture of voices to the input speech to have reality. Thereby, vocal expression of speech can be generated in detail. In other words, even if there is no input speech to be converted, a synthetic speech is generated from an input text and is converted. Thereby, it is possible to convert the speech to a speech with rich vocal expression uttering a "strained rough" voice at an appropriate position. In addition, without using a snippet database and a synthesis parameter database regarding "strained rough" voices, it is possible to generate a strained rough voice using simple signal processing. Thereby, without significantly increasing a data amount and a calculation amount, it is possible to generate voices with realistic emotion having texture such as anger, excitement, or nervousness, an animated or lively way of speaking, or the like in which listeners perceive a degree of tension of a phonatory organ, by reproducing a fine time structure.

It should be noted that it has been described in the fourth embodiment that a strained range is designated when the user designates the strained range in a text using the strained range designation input unit 44, a strained phoneme position is decided in a synthetic speech corresponding to the range in the input text, and thereby a strained rough voice is produced at the strained phoneme position, but the method of producing a strained rough voice is not limited to the above. For example, it is also possible that a text with tag information indicating a strained range as shown in FIG. 24 is received as an input and the strained range designation obtainment unit 51 divides the input into the tag information and the text information to be converted to a synthetic speech and analyzes the tag information to obtain strained range designation information regarding the text. It is further possible that the input of the "strained phoneme position designation unit 46" is designated by a tag designating whether or not each phoneme is to be uttered by a strained rough voice, using a format as disclosed in Patent Reference (Japanese Unexamined Patent Application Publication No. 2006-227589) as shown in FIGS. 24 and 25. Regarding the tag information of FIG. 24, when a range between <voice> tags in a text is to be synthesized, the tag information designates that "quality (voice quality)" of voice in the range is to be synthesized as "strained rough voice". In more detail, a range of "nejimagetanoda (was manipulated)" in a text "Arayuru genjitu o subete jibun no ho e nejimagetanoda (Every fact was manipulated for his/her own convenience)" is designated to be uttered as "strained rough" voice. Regarding the tag information of FIG. 25, the tag information designates phonemes of first five moras in a range between <voice> tags to be uttered as "strained rough" voice.

It should be noted that it has been described in the fourth embodiment that the strained phoneme position decision unit 11 estimates a strained phoneme position using phoneme information and descriptive prosody information such as accents that are provided from the language processing unit 41, but it is also possible that the prosody generation unit 42 as well as the language processing unit 41 are connected to the switch 45 which concatenates an output of the language processing unit 41 and an output of the prosody generation unit 42 to the strained phoneme position decision unit 11. Thereby, using the phoneme information provided from the language processing unit 41 and the numeric value information of fundamental frequency and power provided from the prosody generation unit 42, the strained phoneme position decision unit 11 may perform the estimation of strained phoneme position using phoneme information and a value of a fundamental frequency or power that is prosody information as a physical quantity in the same manner as described in the third embodiment.

It should also be noted that it has been described in the fourth embodiment that the switch input unit 47 is provided to turn the switch 480*n* or Off so that the user can designate a strained phoneme position, but the switch may be turned when the strained phoneme position designation unit 46 receives an input.

It should also be noted that it has been described in the fourth embodiment that the switch 48 switch an input of the strained phoneme position decision unit 11, but the switch 48 may switch connection between the strained phoneme position decision unit 11 and the strained-rough-voice actual time range decision unit 12.

It should also be noted that it has been described in the fourth embodiment that the strained-rough-voice conversion unit 10 performs conversion to a strained rough voice, but the conversion may be performed using the strained-rough-voice conversion unit 20 described in the second embodiment.

It should also be noted that the strained range designation input unit 33 of the third embodiment and the strained range designation input unit 44 of the fourth embodiment have been described to designate a range to be uttered by strained rough voice, but may designate a range not to be uttered by strained rough voice.

It should also be noted that it has been described in the fourth embodiment that the prosody generation unit 42 generates a duration of each phoneme and pose, a fundamental frequency, and a value of amplitude or power, using the pronunciation information and the descriptive prosody information provided from the language processing unit 41, but the prosody generation unit 42 may receive an output of the strained range designation input unit 44 as well as the pronunciation information and the descriptive prosody information, and increase a dynamic range of the fundamental frequency regarding the strained range and further increase an average value of power or amplitude and a dynamic range of the power or amplitude. Thereby, it is possible to convert an original voice to a voice that is uttered being strained and thereby more suitable as a "strained rough" voice, which achieving realistic emotion expression having better texture.

(Another Modification of Fourth Embodiment)

Figure 26:
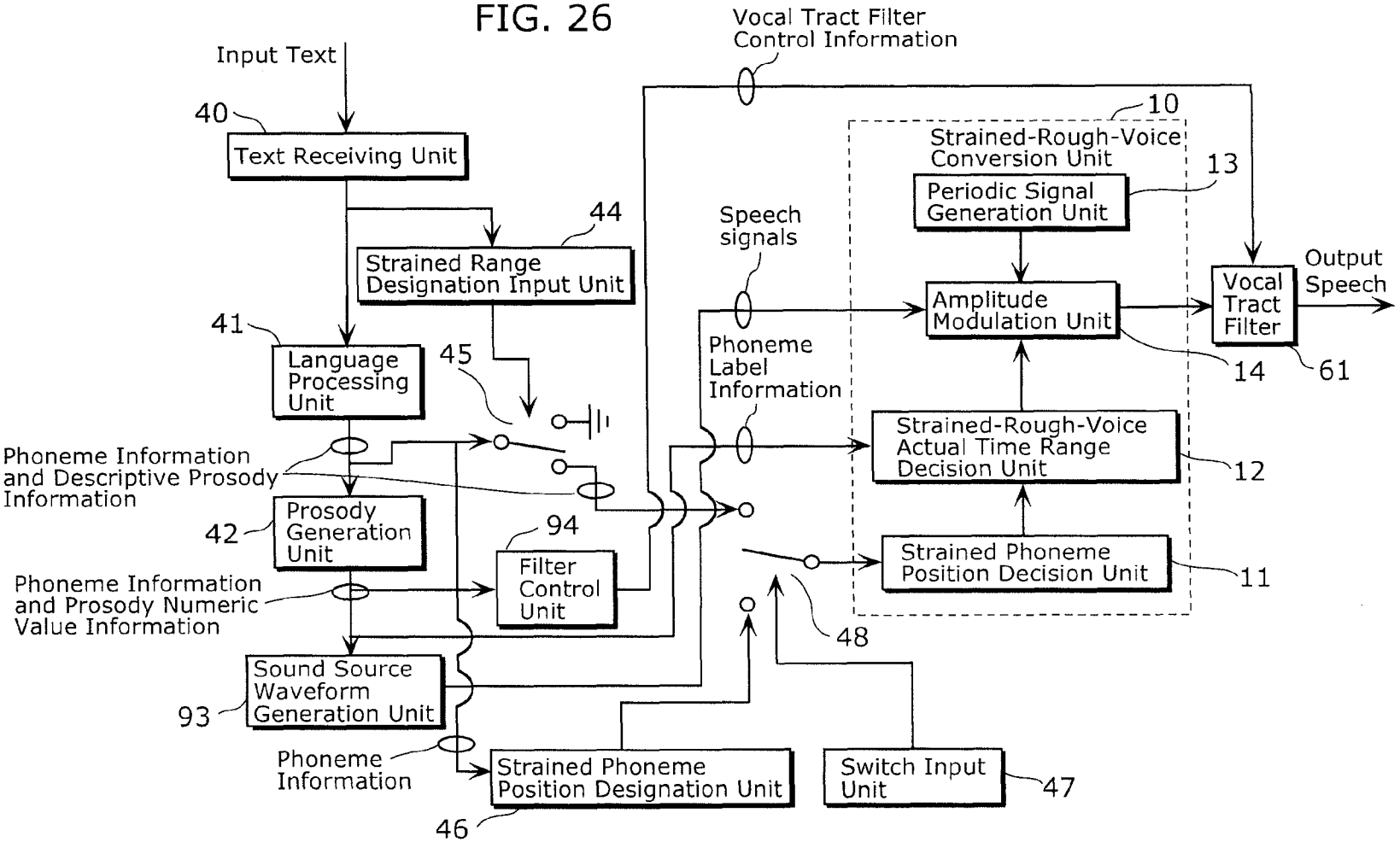
FIG. 26 is a functional block diagram of another modification of the voice synthesis device of the fourth embodiment of the present invention.
Figure 27:
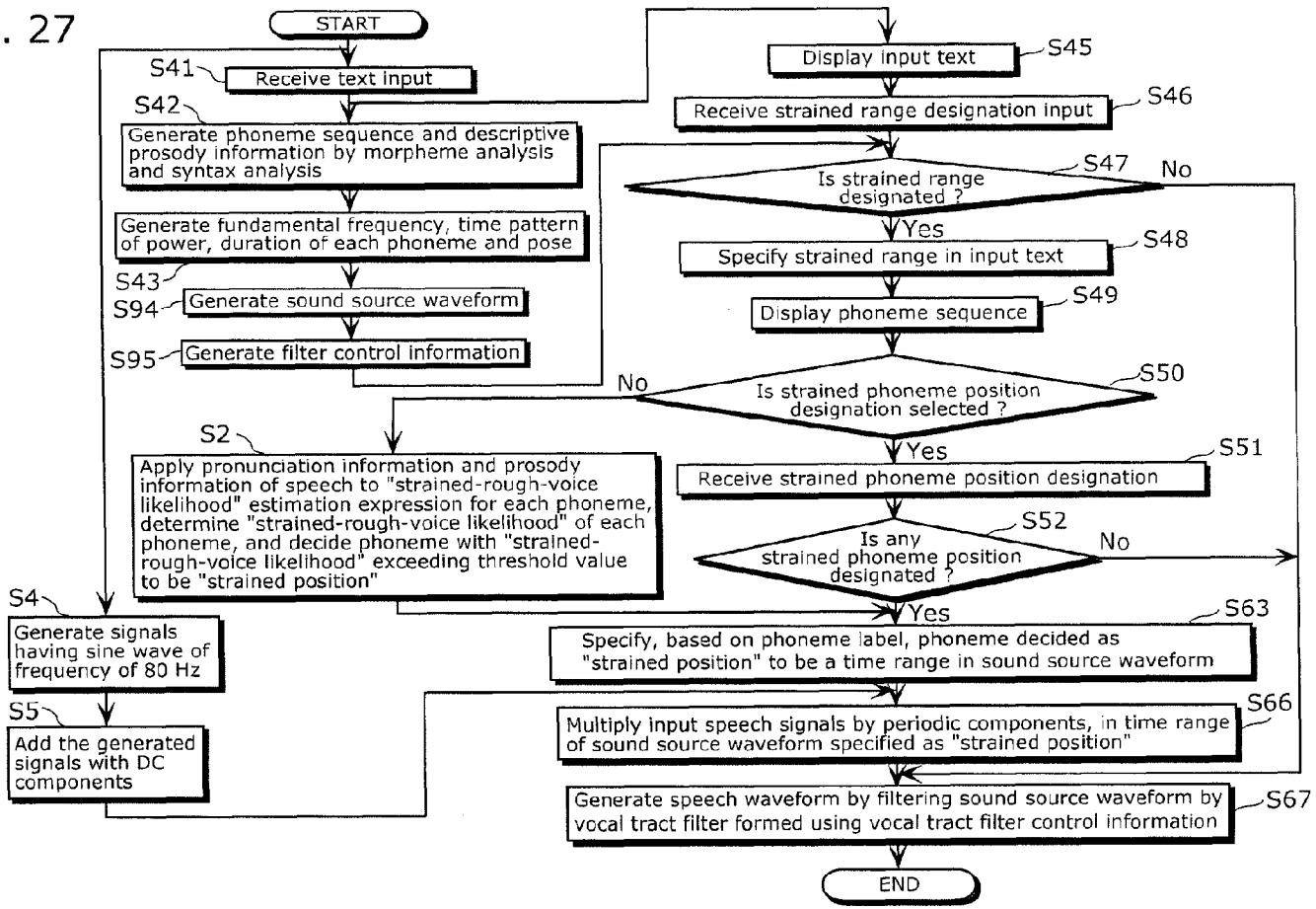
FIG. 27 is a flowchart of processing performed by another modification of the voice synthesis device of the fourth embodiment of the present invention.

FIG. 26 is a functional block diagram of another modification of the voice synthesis device of the fourth embodiment, and FIG. 27 is a flowchart of processing performed by the present modification of the voice synthesis device of the fourth embodiment. The same reference numerals and step numerals of FIGS. 13 and 14 are assigned to the identical units of FIGS. 26 and 27, so that the identical units and steps are not explained again below.

As shown in FIG. 26, like the structure of the fourth embodiment of FIG. 13, the voice conversion device according to the present modification includes the text receiving unit 40, the language processing unit 41, the prosody generation unit 42, the strained range designation input unit 44, the strained phoneme position designation unit 46, the switch input unit 47, the switch 45, the switch 48, and the strained-rough-voice conversion unit 10. In the voice conversion device according to the present modification, the waveform generation unit 43 that generates a speech waveform using waveform concatenation is replaced by a sound source waveform generation unit 93 that generates a sound source waveform and a filter control unit 94 and a vocal tract filter 61 that generate control information for a vocal tract filter.

Next, processing performed by the voice conversion device having the above-described structure is described with reference to FIG. 27. Firstly, the text receiving unit 40 receives an input text (Step S41) and provides the received text both to the language processing unit 41 and the strained range designation input unit 44. The language processing unit 41 generates a phonologic sequence and descriptive prosody information using morpheme analysis and syntax analysis (Step S42). The prosody generation unit 42 receives the phoneme information and the descriptive prosody information from the language processing unit 41, and based on the phonologic sequence and the descriptive prosody information, decides a duration of each phoneme and pose, a fundamental frequency, and a value of power or amplitude (Step S43). The waveform generation unit 93 receives the phoneme information from the language processing unit 41 and the prosody numeric value information from the prosody generation unit 42, and generates a sound source waveform corresponding to those information. (Step S94). The sound source model is, for example, generated by generating a control parameter of a sound source model such as Rosenberg-Klatt model (Non-Patent Reference: "Analysis, synthesis, and perception of voice quality variations among female and male talkers", Klatt, D. and Klatt, L., J. Acoust. Soc. Amer. Vol. 87, 820-857, 1990), according to the phoneme and prosody numeric value information. Examples of a method of generating a sound source waveform using a glottis open degree, sound source spectrum tilt, and the like from among parameters of a source model includes: a method of generating a sound source waveform by statistically estimating the above-mentioned parameters according to a fundamental frequency, power, amplitude, a duration of voice, and phonemes; and a method of selecting, according to phoneme and prosody information, optimum sound source waveforms from a database in which sound source waveforms extracted from natural speeches are recorded and concatenating the selected waveforms with each other; and the like. The waveform generation unit 94 receives the phoneme information from the language processing unit 41 and the prosody numeric value information from the prosody generation unit 42, and generates filter control information corresponding to those information. (Step S95). The vocal tract filter is formed, for example, by setting a center frequency and a band of each of band-pass filters according to phonemes, or by statistically estimating cepstrum coefficients or spectrums based on phonemes, fundamental frequency, power, and the like and then setting coefficients for the filter based on the estimation results. On the other hand, the strained range designation input unit 44 receives a text inputted at Step S41 and provides the received text (input text) to a user (Step 545). The strained range designation input unit 44 receives a strained range which the user designates on the text (Step S46). If the strained range designation input unit 44 does not receive any designation of a portion or all of the input text (No at Step S47), then the strained range designation input unit 44 turns the switch 45 OFF, and thereby the vocal tract filter 61 forms a vocal tract filter based on the filter control information generated at Step S95. The vocal tract filter 61 generates a speech waveform from the sound source waveform generated at Step S94 (Step S67). On the other hand, if the strained range designation input unit 44 receives designation of a portion or all of the input text (Yes at Step S47), then the strained range designation input unit 44 specifies a strained range in the input text and turns the switch 45 ON to be connected to the switch 48 to provide the switch 48 with the phoneme information and the descriptive prosody information generated by the language processing unit 41 and the strained range information. Moreover, the phonologic sequence outputted from the language processing unit 41 is provided to the strained phoneme position designation unit 46 and presented to the user (Step S49). When the user desires to select to perform fine designation on a strained phoneme position basis, switch designation is provided to the switch input unit 47 to allow the strained phoneme position to be designated manually.

If the designation is selected to be performed on a strained phoneme position basis (Yes at Step S50), then the switch input unit 47 connects the switch 48 to the strained phoneme position designation unit 46 in order to receive strained phoneme position designation information from the user (Step S51). If no strained phoneme position is designated (No at Step S52), then the strained phoneme position decision unit 11 does not designate any phoneme as a strained phoneme position, and thereby the vocal tract filter 61 forms a vocal tract filter based on the filter control information generated at Step S95. The vocal tract filter 61 generates a speech waveform from the sound source waveform generated at Step S94 (Step S67). On the other hand, if any strained phoneme position is designated (Yes at Step S52), then the strained phoneme position decision unit 11 decides the phoneme position provided from the strained phoneme position designation unit 46 at Step S51 as a strained phoneme position (Step S63). On the other hand, if the designation is selected not to be performed on a strained phoneme position basis (No at Step S50), then the strained phoneme position decision unit 11 applies the pronunciation information and the prosody information of each phoneme in a strained range specified at Step S48, to the "strained-rough-voice likelihood" estimation expression in order to determine a "strained-rough-voice likelihood" of the phoneme, and decides, as a "strained position", a phoneme having the determined "strained-rough-voice likelihood" that exceeds a predetermined threshold value (Step S2). Based on duration information (namely, phoneme label) of each phoneme provided from the prosody generation unit 42, the strained-rough-voice actual time range decision unit 12 specifies time position information of a phoneme decided to be a "strained position", as a time range in the synthetic speech waveform generated by the sound source waveform generation unit 93 (Step S63). The periodic signal generation unit 13 generates signals having a sine wave having a frequency of 80 Hz (Step S4), and then adds the generated signals with DC components to generate signals (Step S5). The amplitude modulation unit 14 multiplies the sound source waveform by periodic signals, in the time range which is in the sound source waveform and specified as a "strained position" (Step S66). The vocal tract filter 61 forms a vocal tract filter based on the filter control information generated at Step S95, and filters the sound source waveform with modulated amplitude of "strained position" to generate a speech waveform (Step S67).

With the above structure and method, in a designation region designated by a user in an input text, it is decided, using information of each phoneme and based on an estimation rule information of each phoneme, whether or not each phoneme is to be a strained position, and only the phoneme estimated as a strained position is modulated by performing modulation including periodic amplitude fluctuation with a period shorter than a duration of the phoneme, thereby producing a "strained rough" voice at an appropriate position. Or, a phoneme designated by a user in a phonologic sequence used in converting an input text to speech is modulated by performing modulation including periodic amplitude fluctuation with a period shorter than a duration of the phoneme, thereby producing a "strained rough" voice. Thereby, it is possible to prevent unnaturalness of noise superimposition and impression of sound quality deterioration which occur when an input speech is uniformly transformed. In addition, the user designs vocal expression as he/she desires, and thereby reproducing, as a fine time structure, impression of anger, excitement, or nervousness, or animated or lively impression in which listeners perceive a degree of tension of a phonatory organ, and adding the fine time structure as texture of voices to the input speech to have reality. Thereby, vocal expression of speech can be generated in detail. In other words, even if there is no input speech to be converted, a synthetic speech is generated from an input text and is converted. Thereby, it is possible to convert the speech to a speech with rich vocal expression uttering a "strained rough" voice at an appropriate position. In addition, without using a snippet database and a synthesis parameter database regarding "strained rough" voices, it is possible to generate a strained rough voice using simple signal processing. Thereby, without significantly increasing a data amount and a calculation amount, it is possible to generate voices with realistic emotion having texture such as anger, excitement, or nervousness, an animated or lively way of speaking, or the like in which listeners perceive a degree of tension of a phonatory organ, by reproducing a fine time structure. In addition, as described in the modification of the third embodiment, by modulating a sound source waveform not a vocal tract filter mainly related to a shape of a mouth or lips, it is possible to generate a natural "strained rough" voice which is similar to phenomenon of actual utterances and in which listeners hardly perceive artificial distortion.

It should be noted that it has been described that the strained phoneme position decision unit 11 uses the estimation rule based on Quantification Method II in the first to third embodiments and that the strained phoneme position decision unit 11 uses the estimation rule based on SVM in the fourth embodiment, but it is also possible that the estimation rule based on SVM is used in the first to the third embodiments and that the estimation rule based on Quantification Method II is used in the fourth embodiment. It is further possible to use estimation rules based on other methods except the above, for example, an estimation rule based on neural network, and the like.

It should also be noted that it has been described in the third embodiment the speech is added with strained rough voices at real time, but a recorded speech may be used. Furthermore, as described in the fourth embodiment, the strained phoneme position designation unit may be provided to allow a user to designate, from a recorded speech for which phoneme recognition has been performed, a phoneme to be converted to a strained rough voice.

It should also be noted that it has been described in the first to fourth embodiments that the periodic signal generation unit 13 generates periodic signals having a frequency of 80 Hz, but the periodic signals may be generated to have random periodic fluctuation between 40 Hz and 120 Hz in which listeners can perceive the voice as a "strained rough voice". In singing, a duration of a vowel is often extended according to a melody. In such a situation, when a vowel having a long duration (exceeding three seconds, for example) is modulated by fluctuating amplitude with a constant fluctuation frequency, unnatural sound, such as speech with buzzer sound, is sometimes produced. By randomly changing a fluctuation frequency of amplitude fluctuation, the impression of buzzer sound or noise superimposition may be reduced. Therefore, a fluctuation frequency is randomly changed to be closer to amplitude fluctuation of real speeches, thereby achieving generation of a natural speech.

The above-described embodiments are merely examples for all aspects and do not limit the present invention. A scope of the present invention is recited by claims not by the above description, and all modifications are intended to be included within the scope of the present invention with meanings equivalent to the claims and without departing from the claims.

Industrial Applicability

The voice conversion device and the voice synthesis device according to the present invention can generate a "strained rough voice" having a feature different from that of normal utterances, by using a simple technique of performing modulation including periodic amplitude fluctuation with a period shorter than a duration of a phoneme, without having a strained-rough-voice snippet database and a strained-rough-voice parameter database. The "strained rough" voice is produced when expressing: a hoarse voice, a rough voice, and a harsh voice that are produced when a person yells, speaks forcefully with emphasis, and speaks excitedly or nervously; expressions such as "kobushi (tremolo or vibrato)" and "unari (growling or groaning voice)" that are produced in singing Enka (Japanese ballad) and the like, for example; and expressions such as "shout" that are produced in singing blues, rock, and the like. In addition, the "strained rough" voice can be generated at an appropriate position in a speech. Thereby, it is possible to generate voices having rich expression realistically conveying (i) tensed and strained states of a phonatory organ of a speaker and (ii) texture of the voices produced by reproducing a fine time structure. In addition, the user can designs vocal expression where the "strained rough" voice is to be produced in the speech, which makes it possible to finely adjust expression of the speech. With the above features and advantages, the present invention is suitable for vehicle navigation systems, television receivers, electronic devices such as audio systems, audio interaction interfaces such as robots, and the like The present invention can also be used in Karaoke. For example, when a microphone has a "strained rough voice" conversion switch and a singer presses the switch, an input voice can be added with expression such as "strained rough voice", "unari (growling or groaning voice)", or "kobushi (tremolo or vibrato)". Furthermore, by providing a handle grip of a Karaoke microphone with a pressure sensor or a gyro sensor, it is possible to detect strained singing of a singer and then automatically add expression to the singing voice according to the detection result. The expression addition to the singing voice can increase fun of singing.

Still further, when the present invention is used for a loudspeaker in a public speech or a lecture, it is possible to designate a portion to be emphasized to be converted to a "strained rough" voice so as to produce an eloquent way of speaking.

Still further, when the present invention is used in a telephone, a user's speech is converted to a "strained rough" voice such as a "deep threatening voice" and sent to crank callers, thereby fending off crank calls. Likewise, when the present invention is used in an intercom, a user can refuse undesired visitors.

When the present invention is used in a radio, words, categories, and the like to be emphasized are previously registered and thereby only information in which a user is interested is converted to "strained rough" voice to be outputted, so that the user does not miss the information. Moreover, in the fields of content distribution, the present invention can be used to emphasize an appeal point of information suitable for a user by changing a "strained rough voice" range of the same content depending on characteristics and situations of the user.

When the present invention is used for audio guidance in establishments, "strained rough" voice is added to the audio guidance according to risk, emergency, or importance of the guidance, in order to alert listeners.

Still further, when the present invention is used in an audio output interface indicating situations of an inside of a device, "strained rough voice" is added to output audio in the situations where an operation status of the device is high or where a calculation amount is large, for example, thereby expressing that the device "works hard". Thereby, the interface can be designed to provide a user with friendly impression.

The invention claimed is:

1. A strained-rough-voice conversion device comprising:

one or more processors executing:

a strained phoneme position designation unit configured to designate a phoneme to be converted to a strained rough voice in a speech; and a modulation unit configured to perform amplitude modulation on a speech waveform so as to periodically fluctuate a curved outline of the speech waveform, the speech waveform expressing the phoneme designated by said strained phoneme position designation unit, wherein the amplitude modulation performed by said modulation unit on the speech waveform includes performing periodic amplitude fluctuation on the speech waveform by multiplying (i) the speech waveform expressing the phoneme designated by said strained phoneme position designation unit by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated by said strained phoneme position designation unit.

2. The strained-rough-voice conversion device according to claim 1, wherein the periodic amplitude fluctuation performed by said modulation unit is performed at a modulation degree in a range from 40% to 80% which represents a range of fluctuating amplitude in percentage.

3. The strained-rough-voice conversion device according to claim 1, wherein said modulation unit includes:

an all-pass filter shifting a phase of the speech waveform expressing the phoneme designated by said strained phoneme position designation unit; and an addition unit configured to add (i) the speech waveform having the phase shifted by said all-pass filter to (ii) the speech waveform expressing the phoneme designated by said strained phoneme position designation unit.

4. The strained-rough-voice conversion device according to claim 2, wherein said modulation unit includes:

an all-pass filter shifting a phase of the speech waveform expressing the phoneme designated by said strained phoneme position designation unit; and an addition unit configured to add (i) the speech waveform having the phase shifted by said all-pass filter to (ii) the speech waveform expressing the phoneme designated by said strained phoneme position designation unit.

5. The strained-rough-voice conversion device according to claim 1, wherein said one or more processors further execute:

a strained range designation unit configured to designate a range of a speech including the phoneme designated by said strained phoneme position designation unit to be converted in the speech.

6. The strained-rough-voice conversion device according to claim 2, wherein said one or more processors further execute:

a strained range designation unit configured to designate a range of a speech including the phoneme designated by said strained phoneme position designation unit to be converted in the speech.

7. A voice conversion device comprising:

one or more processors executing:

a receiving unit configured to receive a speech waveform;

a strained phoneme position designation unit configured to designate a phoneme to be converted to a strained rough voice; and a modulation unit configured to perform, in accordance with the phoneme to be converted to the strained rough voice designated by said strained phoneme position designation unit, amplitude modulation on the speech waveform so as to periodically fluctuate a curved outline of the speech waveform, the speech waveform expressing the phoneme designated by said strained phoneme position designation unit, wherein the amplitude modulation performed by said modulation unit on the speech waveform includes performing periodic amplitude fluctuation on the speech waveform by multiplying (i) the speech waveform expressing the phoneme designated by said strained phoneme position designation unit by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated by said strained phoneme position designation unit.

8. The voice conversion device according to claim 7, wherein said one or more processors further execute:

a strained range designation input unit configured to designate, in a speech, a range including the phoneme to be converted to the strained rough voice designated by said strained phoneme position designation unit.

9. The voice conversion device according to claim 7, wherein said one or more processors further execute:

a phoneme recognition unit configured to recognize a phonologic sequence of the speech waveform; and a prosody analysis unit configured to extract prosody information from the speech waveform, wherein said strained phoneme position designation unit is configured to designate the phoneme to be converted to the strained rough voice based on (i) the phonologic sequence recognized by said phoneme recognition unit regarding the speech waveform and (ii) the prosody information extracted by said prosody analysis unit.

10. A voice conversion device comprising:

one or more processors executing:

a receiving unit configured to receive a speech waveform;

a strained phoneme position input unit configured to receive, from a user, an input designating the phoneme to be converted to the strained rough voice; and a modulation unit configured to perform, in accordance with the input designating the phoneme to be converted to the strained rough voice received by said strained phoneme position input unit, amplitude modulation on the speech waveform so as to periodically fluctuate a curved outline of the speech waveform, the speech waveform expressing the phoneme designated by the input from the user, wherein the amplitude modulation performed by said modulation unit on the speech waveform includes performing periodic amplitude fluctuation on the speech waveform by multiplying (i) the speech waveform expressing the phoneme designated by the input from the user by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated by the input from the user.

11. A voice synthesis device comprising:

one or more processors executing:

a receiving unit configured to receive a text;

a language processing unit configured to analyze the text received by said receiving unit to generate pronunciation information and prosody information;

a voice synthesis unit configured to synthesize a speech waveform according to the pronunciation information and the prosody information;

a strained phoneme position designation unit configured to designate, in the speech waveform, a phoneme to be converted to a strained rough voice; and a modulation unit configured to perform, in accordance with the phoneme to be converted to the strained rough voice designated by said strained phoneme position designation unit, amplitude modulation on the speech waveform so as to periodically fluctuate a curved outline of the speech waveform, the speech waveform expressing the phoneme designated by said strained phoneme position designation unit, wherein the amplitude modulation performed by said modulation unit on the speech waveform includes performing periodic amplitude fluctuation on the speech waveform by multiplying (i) the speech waveform expressing the phoneme designated by said strained phoneme position designation unit by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated by said strained phoneme position designation unit.

12. The voice synthesis device according to claim 11, wherein said one or more processors further execute:

a strained range designation input unit configured to designate, in the speech waveform, a range including the phoneme to be converted to the strained rough voice designated by said strained phoneme position designation unit.

13. The voice synthesis device according to claim 11, wherein said receiving unit is configured to receive the text including (i) a content to be converted and (ii) information that designates a feature of a speech to be synthesized and that has information of the range including the phoneme to be converted to the strained rough voice, and wherein said one or more processors further execute a strained range designation obtainment unit configured to analyze the text received by said receiving unit to obtain the range including the phoneme to be converted to the strained rough voice.

14. The voice synthesis device according to claim 11, wherein said strained phoneme position designation unit is configured to designate the phoneme to be converted to the strained rough voice based on the pronunciation information and the prosody information that are generated by said language processing unit.

15. The voice synthesis device according to claim 11, wherein said strained phoneme position designation unit is configured to designate the phoneme to be converted to the strained rough voice based on (i) the pronunciation information generated by said language processing unit and (ii) at least one of a fundamental frequency, power, amplitude, a duration of a phoneme of the speech waveform synthesized by said voice synthesis unit.

16. The voice synthesis device according to claim 11, wherein said one or more processors further execute:

a strained phoneme position input unit configured to receive, from a user, an input designating the phoneme to be converted to the strained rough voice, wherein said modulation unit performs the amplitude modulation on the speech waveform in accordance with the input designating the phoneme to be converted to the strained rough voice received by said strained phoneme position input unit.

17. A voice conversion method comprising:

designating a phoneme to be converted to a strained rough voice in a speech; and performing, using a processor, amplitude modulation on a speech waveform so as to periodically fluctuate a curved outline of the speech waveform, the speech waveform expressing the phoneme designated in said designating, wherein the amplitude modulation performed in said modulating on the speech waveform includes performing periodic amplitude fluctuation on the speech waveform by multiplying (i) the speech waveform expressing the phoneme designated in said designating by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated in said designating.

18. A voice synthesis method comprising:

designating a phoneme to be converted to a strained rough voice; and generating, using a processor, a synthetic speech by performing amplitude modulation on a speech waveform so as to periodically fluctuate a curved outline of the speech waveform, the speech waveform expressing the phoneme designated in said designating, wherein the amplitude modulation performed in said modulating on the speech waveform includes performing periodic amplitude fluctuation on the speech waveform by multiplying (i) the speech waveform expressing the phoneme designated in said designating by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated in said designating.

19. A non-transitory computer readable recording medium having stored thereon a voice conversion program, wherein, when executed, said voice conversion program causes a computer to execute a method comprising:

designating a phoneme to be converted to a strained rough voice in a speech; and performing amplitude modulation on a speech waveform so as to periodically fluctuate a curved outline of the speech waveform, the speech waveform expressing the phoneme designated in said designating, wherein the amplitude modulation performed in said modulating on the speech waveform includes performing periodic amplitude fluctuation on the speech waveform by multiplying (i) the speech waveform expressing the phoneme designated in said designating by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated in said designating.

20. A non-transitory computer readable recording medium having stored thereon a voice synthesis program, wherein, when executed, said voice synthesis program causes a computer to execute a method comprising:

designating a phoneme to be converted to a strained rough voice; and generating a synthetic speech by performing amplitude modulation on a speech waveform so as to periodically fluctuate a curved outline of the speech waveform, the speech waveform expressing the phoneme designated in said designating, wherein the amplitude modulation performed in said modulating on the speech waveform includes performing periodic amplitude fluctuation on the speech waveform by multiplying (i) the speech waveform expressing the phoneme designated in said designating by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the speech waveform expressing the phoneme designated in said designating.

21. A strained-rough-voice conversion device comprising:

one or more processors executing:

a strained phoneme position designation unit configured to designate a phoneme to be converted to a strained rough voice in a speech; and a modulation unit configured to perform amplitude modulation on a sound source signal of a speech waveform so as to periodically fluctuate a curved outline of the speech waveform, the speech waveform expressing the phoneme designated by said strained phoneme position designation unit, wherein the amplitude modulation performed by said modulation unit on the sound source signal includes performing periodic amplitude fluctuation on the sound source signal by multiplying (i) the sound source signal expressing the phoneme designated by said strained phoneme position designation unit by (ii) a periodic fluctuation signal, the periodic fluctuation signal being generated according to a distribution of a fluctuation frequency of an amplitude envelope of a strained rough voice, the fluctuation frequency being a mode value of a frequency calculated for each of a plurality of points over a sampling period of the amplitude envelope of the strained rough voice, and the periodic fluctuation signal having one of frequencies in a range of 40 Hz to 120 Hz, and wherein the frequency of the periodic fluctuation signal is different from the fundamental frequency of the sound source signal expressing the phoneme designated by said strained phoneme position designation unit.

* * * * *